United States Patent [19]

Tatsumi et al.

[11] Patent Number: 4,955,344

[45] Date of Patent: Sep. 11, 1990

[54] APPARATUS FOR CONTROLLING ROTATIONAL SPEED OF PRIME MOVER OF CONSTRUCTION MACHINE

[75] Inventors: Akira Tatsumi, Chiba; Toichi Hirata, Ibaragi; Masaki Egashira, Ibaragi; Osamu Tomikawa, Ibaragi; Hiroshi Watanabe, Ibaragi, all of Japan

[73] Assignee: Hitachi Construction Machinery Co., Ltd., Tokyo, Japan

[21] Appl. No.: 374,836

[22] Filed: Jul. 3, 1989

[30] Foreign Application Priority Data

Jul. 4, 1988 [JP] Japan ..... 63-166317

[51] Int. Cl.[5] ..... F02M 39/00

[52] U.S. Cl. ..... 123/352; 123/357; 123/365; 414/699

[58] Field of Search ..... 123/352, 357, 365, 385, 123/386; 414/699

[56] References Cited

U.S. PATENT DOCUMENTS

| | | | |
|---|---|---|---|
| 4,373,850 | 2/1983 | Durham | 414/699 |
| 4,638,779 | 1/1987 | Kitada | 123/357 X |
| 4,773,369 | 9/1988 | Kobayashi et al. | 123/357 |
| 4,774,921 | 10/1988 | Sakaguchi et al. | 123/385 |
| 4,776,164 | 10/1988 | Barbagli | 123/357 X |
| 4,779,591 | 10/1988 | Tordenmalm | 123/352 |
| 4,838,755 | 6/1989 | Johnson et al. | 123/385 X |
| 4,864,994 | 9/1989 | Myers | 123/386 |

FOREIGN PATENT DOCUMENTS

| | | | |
|---|---|---|---|
| 0073288 | 3/1983 | European Pat. Off. | 123/352 |
| 0068543 | 4/1982 | Japan | 123/352 |

*Primary Examiner*—Willis R. Wolfe

*Attorney, Agent, or Firm*—Cushman, Darby & Cushman

[57] ABSTRACT

A controller having an up/down switch for changing the rotational speed of a prime mover such as an engine, an actuator such as an electric motor for driving a governor on the basis of the operation of the up/down switch so as to control the rotational speed of the prime mover. A target speed is calculated on the basis of the operation of the up/down switch, and the prime mover speed is controlled by using the calculated value. Another switch is provided to immediately shift the prime mover speed to a speed previously set as desired. This shift switch is used to control the prime mover so that the prime mover rotates at the set speed, and this speed is adjusted by operating the up/down switch.

33 Claims, 21 Drawing Sheets

APPARATUS FOR CONTROLLING ROTATIONAL SPEED OF PRIME MOVER OF CONSTRUCTION MACHINE

BACKGROUND OF THE INVENTION

This invention relates to an apparatus for controlling the rotational speed of a prime mover of a construction machine such as a hydraulic shovel or a crane.

A prime mover speed controller of this kind, such as the one disclosed in Japanese Utility Model Laid-Open No. 61-145849, is known which is capable of remote-controlling an engine governor. This controller transmits a value which represents the operation of an operational section to an operational value detector through a link or the like to obtain a command signal corresponding to the operational value. This command signal is transmitted to a control circuit which controls a motor which rotates to drive the governor.

Since this type of apparatus necessitates the provision of an operational value detector (e.g., potentiometer or pulse encoder) for detecting the value representing the operation of the operational section, it entails the following problems.

1. It is necessary to correct the output from the operational value detector by the control circuit because the linearity of the output from the operational value detector with respect to the operational value is not sufficiently high.
2. A component such as a link for connecting the operating section and the operational value detector is needed. The number of component parts is thereby increased and the resulting structure is complicated.
3. A process of adjusting the operating section and the operational value detector is needed.
4. If a potentiometer is used as the operational value detector, a constant voltage power source for driving the potentiometer is needed. Since the output from the potentiometer is an analogue signal, it is necessary to cope with the problem of noise. The potentiometer has a specific structure which includes slide members and is therefore disadvantageous in terms of reliability and durability. Moreover, the provision of an A/D converter for converting the analogue signal from the potentiometer into a digital signal is necessitated if a control system in which the target engine speed is calculated with a microcomputer and in which a control lever of the governor is driven by a pulse motor is adopted.
5. Ordinarily, in construction machines, the position of the control lever of the governor is constantly maintained and the machine is operated by depending upon a fuel injection control function of the governor. There is a risk of the operational section being accidentally operated because large vibrations or impacts are caused during working. There is therefore a need for a mechanical lock means for constantly maintaining the position of the operational section.
6. In a case where this type of prime mover speed controller is applied to a hydraulic power shovel, certain problems in terms of operability are encountered, as described below. Hydraulic shovel working is performed by operating a pair of working levers disposed on the left-hand and right-hand sides of a cockpit to effect operations of a boom, an arm and a bucket and revolution. If the above-described operational section is provided in a panel disposed in a side section of the cockpit separately from these working levers, the operator must stop working by releasing one hand from the working lever when he wishes to change the engine speed during working. Even if the operational section is provided in a grip portion of one of the working lever in the conventional system, it is necessary to effect a rotary operation of the operational section to a position corresponding to the absolute value of the engine speed. The working is therefore stopped substantially in order to change the engine speed. This procedure is disadvantageous in terms of operability.
7. In the case of a type of prime mover controller which has a set speed command means which issues a command to shift the rotational speed of the prime mover to at least one set speed (e.g., a controller which has a power mode and an economy mode and which shifts the engine speeds in accordance with the selected mode), the following problems are encountered.
   (a) There is a possibility of occurrence of non-conformity of the operational position of the operational section with the engine speed and, hence, a possibility of the operator being confused.
   (b) It is difficult to finely change the rotational speed on the basis of the set speed.
8. Each time the engine is started, it is necessary to operate the operational section to set a rotational speed suitable for starting. If in the conventional system the engine is controlled to rotate at the desired speed in synchronism with the starting operation, non-conformity of the operational position of the operational section with the engine speed takes place.

SUMMARY OF THE INVENTION

An object of the present invention is to provide an apparatus for controlling the rotational speed of a prime mover of a construction machine free from these problems In accordance with the present invention, an apparatus for controlling the rotational speed of a prime mover of a construction machine has a basic construction including, as shown in FIGS. 1A to 1E, a prime mover controller means 1*a* such as a governor for controlling the output from a prime mover 1, a drive means 3 such as a motor for driving the prime mover control means 1*a*, and an up/down command operation means 6 such as a pair of push switches operated between an up position at which it outputs an up signal for increasing the rotational speed of the prime mover 1 and a down position at which it outputs a down signal for reducing the rotational speed of the prime mover 1.

In one of the aspects of the present invention corresponding to claim 1, there is provided an apparatus having the above basic construction and further having, as shown in FIG. 1A, a signal transmission means 101 for supplying a drive signal to the drive means 3 whereby the prime mover speed is increased on the basis of the up signal or is reduced on the basis of the down signal.

In another aspect of the present invention corresponding to claim 2, there is provided the apparatus further having, as shown in a section within the broken line in FIG. 1A, a set speed command means 35 for issuing a command to shift the prime mover speed to at least one set speed previously determined as desired; and a shift means 36 for shifting the prime mover speed to the set speed on the basis of a set speed command signal output from the set speed command means 35.

In still another aspect of the present invention corresponding to claim 3, the signal transmission means 101 of claim 1 includes, as shown in Fig. 1B, a control means 10 such as a microcomputer for calculating a target speed Nr of the prime mover 1 to which the prime mover speed is increased on the basis of the up signal or to which the prime mover speed is reduced on the basis of the down signal, the control means supplying the drive signal to the drive means so that the prime mover speed is adjusted to the target speed Nr.

In a further one of the aspects of the present invention corresponding to claim 4, there is provided the apparatus for controlling the prime mover speed further having, in addition to the arrangement of claim 3 and as shown in FIG. 1C, a set speed command means 7 for issuing a command to shift the prime mover speed to at least one set speed previously determined as desired, wherein the control means 10 has, in addition to the function relating to claim 3, a function of calculating a target prime mover speed on the basis of a set speed command signal output from the set speed command means 7 whereby the prime mover speed is adjusted to the corresponding set speed, e.g., $N_E$, and a function of changing the calculated target speed on the basis of the up or down signal, as in the above.

In a further one of the aspects of the present invention corresponding to claim 5, there is provided an apparatus for controlling the rotational speed of a prime mover of a construction machine having, as shown in Fig. 1D, a hydraulic pump 22 driven by the prime mover 1, an actuator 24 driven by oil discharged from the hydraulic pump 22 and an operating means 25 for controlling the operation of the actuator 24, the apparatus having the above-described basis construction and further having: a detection means 26 for detecting an operational value which represents the operation of the operation means 25; and a control means 10 for calculating a first target speed $Nr_1$ of the prime mover 1 on the basis of the up or down signal, and a second target speed $Nr_2$ on the basis of the operational value from the operating means 25, the control means 10 supplying a drive signal to the drive means 3 whereby the prime mover speed is adjusted to the higher one of the first and second target speeds.

In a further one of the aspects of the present invention corresponding to claim 6, there is provided an apparatus for controlling the prime mover speed further having, as shown in FIG. 1E, a prime mover speed control value detecting means 5 for detecting a value for control of the prime mover speed effected by the prime mover controller means 1*a*, wherein the control means 10 outputs the drive signal when the difference between the detected control speed and the target speed is larger than a predetermined value.

In a further one of the aspects of the present invention corresponding to claim 7, the drive means 3 is driven when the difference between present and past target speeds calculated by the control means 10 is larger than a predetermined value, and the prime mover speed is controlled in feedforward control manner In a further one of the aspects of the present invention corresponding to claim 8, the target speed is set to a predetermined start rotational speed when the prime mover 1 is started.

In a further one of the aspects of the present invention corresponding to claim 9, the control means 10 controls the drive means 3 in response to stoppage of the prime mover 1 so as to set the drive means 3 to a position corresponding to a predetermined start rotation speed.

In a further one of the aspects of the present invention corresponding to claims 10 to 13, when the target speed is within a predetermined rotational speed range, the driving speed of the drive means 3 is increased if the present target speed or the control speed is higher, if the period of time when the up/down command operation means 6 is longer, or if the difference between the present target speed and the control speed is larger.

In a further one of the aspects of the present invention corresponding to claim 14, each of the above-described apparatus is applied to a construction machine such as a hydraulic power shovel having a hydraulic pump driven by the prime mover, a plurality of actuators driven by oil discharged from the hydraulic pump and a plurality of operating means provided in association with the actuators to control the operations of the same.

If, in the apparatus corresponding to claim 1, a command to change the prime mover speed is issued by the operation of the up/down command operation means 6, the drive signal in accordance with this changing command is supplied to the drive means through the signal transmission means 101, and the rotational speed of the prime mover 1 is changed by the prime mover control means 1*a*.

If, in the apparatus corresponding to claim 2, the prime mover speed is shifted to a set speed by the shift means 36 when the set speed command means 35 is operated.

If, in the apparatus corresponding to claim 3, a command to increase the prime mover speed is issued by the operation of the up/down command operation means 6, the control means calculates the target speed Nr on the basis of the operation of the up/down command operation means 6 and controls the drive means 3 and the prime mover control means 1*a* to adjust the rotational speed of the prime mover 1 to the target speed Nr.

If, in the apparatus corresponding to claim 4, a set speed command signal corresponding to at least one speed previously set as desired is output by the operation of the set speed command means 7, the control means 10 calculates a a target speed of the prime mover 1, e.g., $N_E$, and supplies a drive signal to the drive means to adjust the prime mover speed to $N_E$. The control means 10 also calculates a new target speed by changing the preceding target speed on the basis of the up or down signal, and changes the prime mover speed 3 through the drive means 3.

In the apparatus corresponding to claim 5, the operational value supplied from the operating means 25 for controlling the actuator 24 is detected by the detecting means 26. The control means 10 calculates the first target speed $Nr_1$ on the basis of the up or down signal and the second target speed $Nr_2$ on the basis of the operational value from the operating means 25, and supplies the drive signal to the drive means 3 so that the prime mover speed becomes equal to the higher one of these target speeds.

In the apparatus according to claim 6, a value of control of the prime mover speed effected by the prime mover control means 1*a*, i.e., a control speed is detected. The control means 10 outputs the drive signal to the drive means so long as the difference between the detected control speed and the target speed is equal to or larger than a predetermined value, and stops the supply of the drive signal and, hence, changing the prime mover speed when the difference becomes smaller than the predetermined value. That is, the prime mover speed is controlled in a close-loop control manner.

In the apparatus corresponding to claim 7, the difference between two present and past target speeds is calculated, and the prime mover speed is changed by driving the drive means 3 when the difference is equal to or larger than a predetermined value. Driving of the drive means 3 is stopped when the difference becomes smaller than the predetermined value, thereby terminating the operation of changing the prime mover speed. That is, the prime mover speed is changed in an open-loop control manner.

In the apparatus corresponding to claim 8, the target speed is automatically set to a predetermined start rotation speed suitable for starting the prime mover, when the prime mover is to be started. The prime mover can be started at the desired speed irrespective of the speed at which it rotates when the preceding operation is stopped.

In the apparatus corresponding to claim 9, the drive means 3 is controlled to be set to the position corresponding to a start rotation speed suitable for starting the prime mover, when the prime mover is stopped. Thereafter, the prime mover 1 can be restarted at this start rotation speed.

In the apparatus corresponding to claims 10 to 13, the driving speed of the drive means 3 is increased if the present target speed or the control speed is higher, if the period of time when the up/down command operation means 6 is longer, or if the difference between the present target speed and the control speed is larger. It is therefore possible to maintain the desired operability even in a case where an up/down switch type of control system is adopted.

In accordance with the present invention, there is no need for detecting the value representing the operation of the operational section for controlling the prime mover speed, and it is sufficient to detect the operational position of the up/down switch serving as the operational section, i.e., whether the prime mover speed is to be increased or reduced. The need for the conventional type of operational value detector is thereby eliminated, thereby enabling simplification of the construction of apparatus as well as in an improvement in the operability. The present invention is further advantageous in terms of reliability and durability as compared with the conventional arrangement having a potentiometer used as the operational value detector, because there is no need for a process of correcting the linearity of the output from the detector and, hence, no need for adjustment, a constant voltage power source and means to cope with the problem of noise. In a case where the prime mover speed is controlled in a digital control manner, there is no need for the provision of any A/D converter such as that necessary for the conventional potentiometer type.

The apparatus corresponding to claims 2 and 4 are capable of controlling the prime mover speed so that this speed is immediately adjusted to a set speed selected as desired while maintaining the desired operability. The prime mover speed can be finely adjusted by the up/down command operation means on the basis of the set speed.

In the apparatus corresponding to claim 5, the prime mover speed is controlled to be adjusted to the higher one of the second target speed obtained from the operational value from the operating means such as a working actuator for excavation or revolution or a traveling actuator and the first target speed obtained by the up/down command operation means, thereby enabling an improvement in fuel consumption, limitation of exhaustion of smoke and a reduction in noise.

The apparatus corresponding to claim 6 is capable of positively setting the prime mover speed to the target value in a feedback control manner, and the apparatus corresponding to claim 7 is capable of controlling the prime mover speed in a feedforward control manner and is therefore free from the problem of second-order lag of the servo system due to a reduction in the response time or inertia of the driving means controlled by feedback, thus stabilizing the control of the rotational speed of the prime mover.

The apparatus corresponding to claims 8 and 9 enables the prime mover speed at the time of starting to be adjusted to a predetermined start rotational speed irrespective of the target speed maintained when the preceding operation is stopped. There is no need for reset the target speed to a value suitable for starting each time the prime mover is started, thus improving the operability.

The apparatus corresponding to claims 10 to 13 are capable of increasing the rate at which the prime mover speed is changed if the difference between the the target speed and the present speed is large, while they are capable of finely adjusting the prime mover speed by minimizing the change in the prime mover speed created by the operation of the up/down command means. The rotational speed of the prime mover can therefore be rapidly adjusted to the target value while finely operable performance is achieved.

DESCRIPTION OF THE PREFERRED EMBODIMENTS

First Embodiment

A first embodiment of the present invention will be described below with reference to FIGS. 2, 3A, and 4A.

Figure 1A:
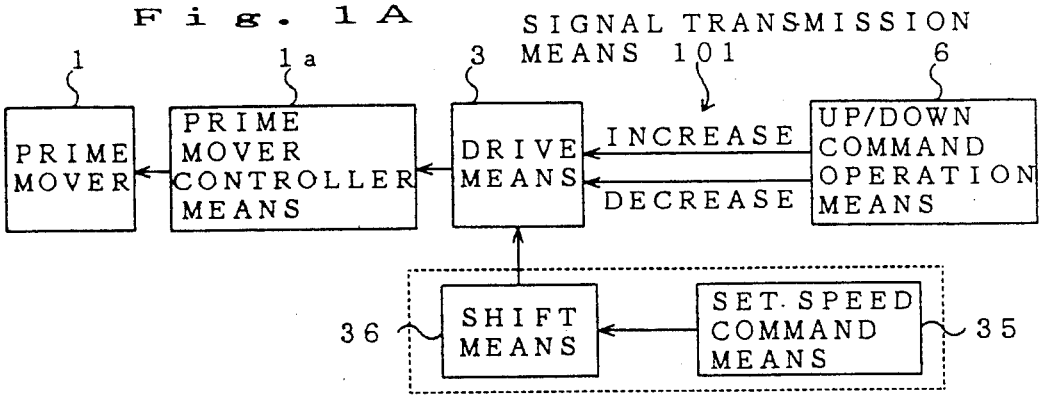
FIGS. 1A to 1E are diagrams of examples of the construction in accordance with of the present invention.
Figure 1B:
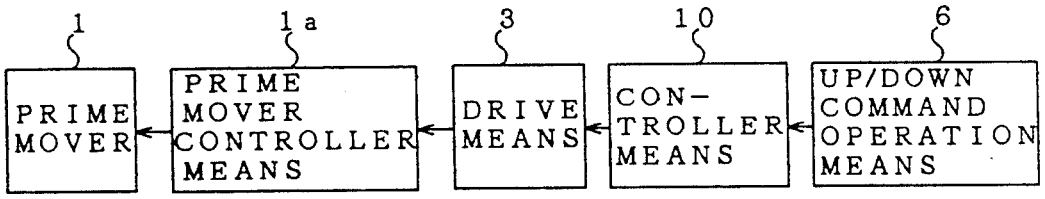
Figure 1C:
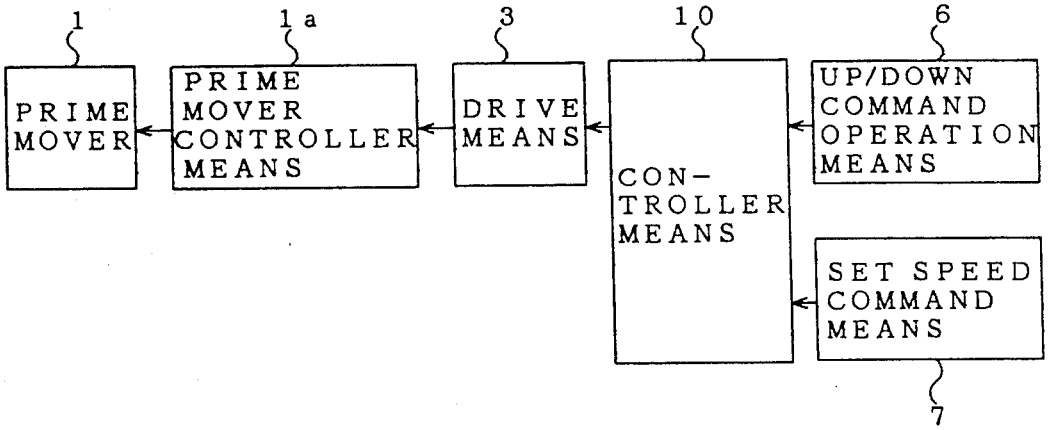
Figure 1D:
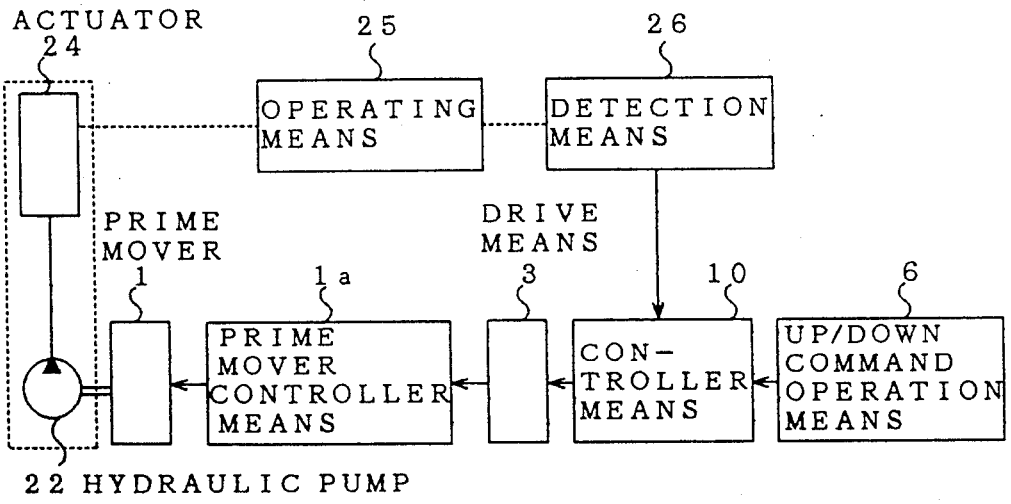
Figure 1E:
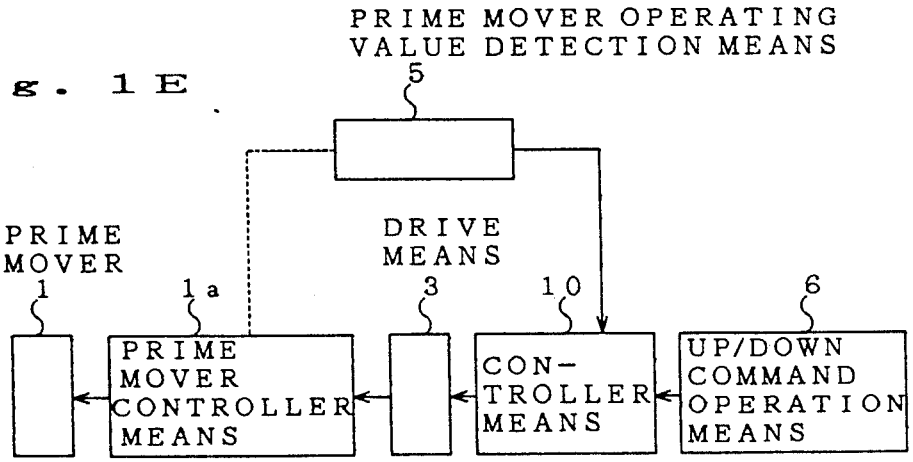
Figure 2:
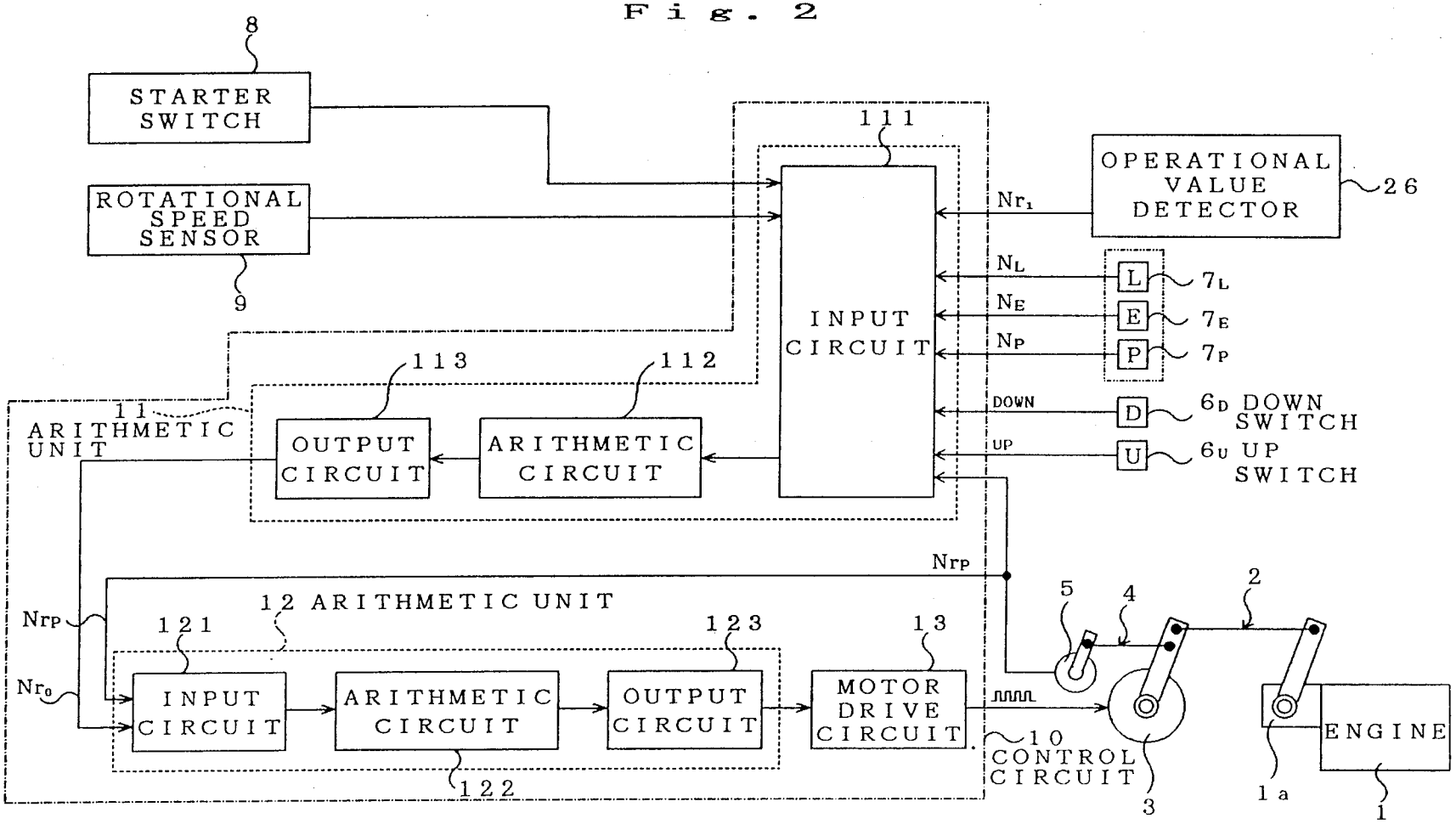
FIG. 2 is a diagram of the overall construction of an engine speed control apparatus which represents a first embodiment of the present invention.

Referring first to FIG. 2, the overall construction of an apparatus for controlling the rotational speed of a prime mover is illustrated. The speed of rotation of a prime mover 1 such as an engine is controlled with a governor 1*a* which is connected to a pulse motor 3 by a link mechanism 2 and which is driven by the rotation of the pulse motor 3 to control the speed of rotation of the engine 1. A potentiometer 5 is connected to the pulse motor 3 by a link mechanism 4, and the rotational position of the potentiometer 5 is detected as a detected governor lever position value Nrp which will be explained later. The rotation of the pulse motor 3 is controlled on the basis of a motor drive signal supplied from a control circuit 10.

The control circuit 10 has arithmetic units 11 and 12 and a motor drive circuit 13. The arithmetic unit 11 has an input circuit 111, an arithmetic circuit 112 for calculating a target governor lever position value Nro, and an output circuit 113. The potentiometer 5, an up switch $6_U$ and a down switch $6_D$ are respectively connected to the input circuit 111. Each of the up switch $6_U$ and the down switch $6_D$ is an automatic-return on-off switch which outputs a high level signal when maintained in the on state. The arithmetic unit 12 has an input circuit, an arithmetic circuit 122 and an output circuit 123. The arithmetic circuit 122 calculates the direction of rotation of the pulse motor 3 on the basis of the target governor lever position value Nro supplied (corresponding to the target engine speed) and the detected governor lever position value Nrp (which is a value of engine speed control based on the pulse motor 3, and which is different from the actual engine speed). The potentiometer 5 and the output circuit 113 of the arithmetic unit 11 are connected to the input circuit 121. The motor drive circuit 13 supplies a motor drive signal to the pulse motor 3 in accordance with a motor rotational direction command supplied from the arithmetic unit 12. This motor drive signal is composed of a pulse train supplied at a predetermined frequency which may be varied as explained later.

The process of engine speed control in accordance with the first embodiment will be explained below with reference to FIGS. 3A and 4A.

Figure 3A:
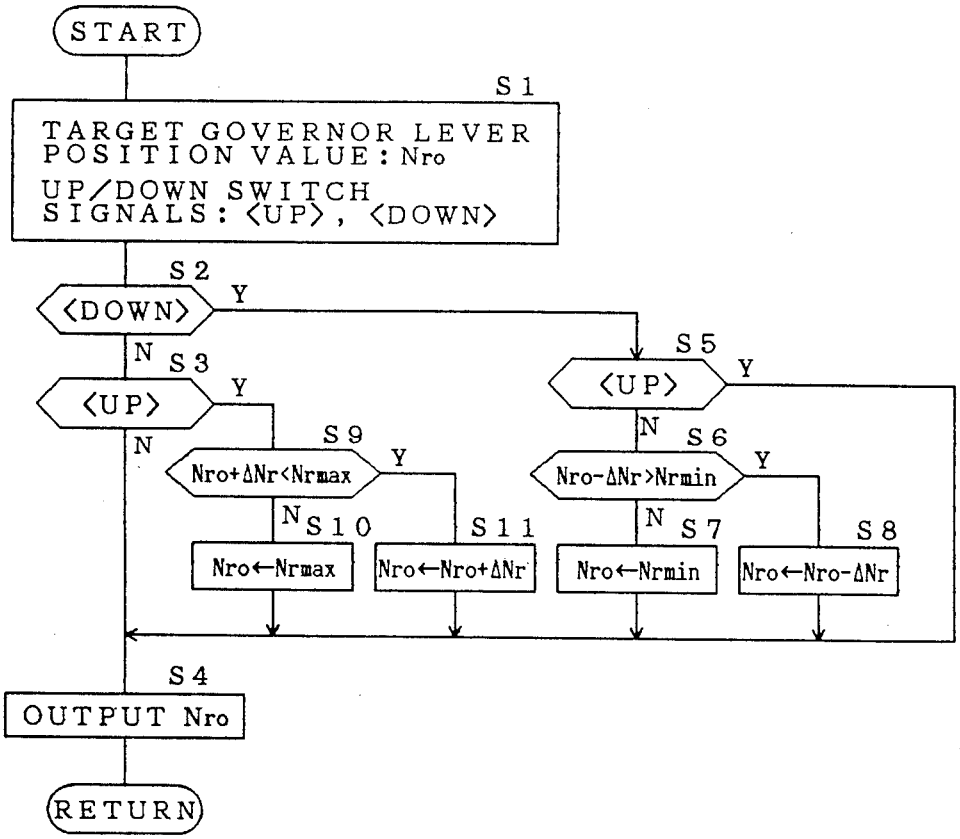
FIGS. 3A and 4A are flow charts of processes executed by arithmetic units 11 and 12 of the apparatus shown in FIG. 2.

FIG. 3A shows a process which is executed by the arithmetic unit 11. In step S1 of this process, the target governor lever position value Nro is read, and a signal UP or DOWN which is supplied from the up switch $6_U$ or the down switch $6_D$ is also read. In step S2, determination is made as to whether or not signal DOWN exists. If YES, the process proceeds to step S5, and determination is made as to whether or not signal UP exists. If NO, the process proceeds to step S6. In step S6, the relationship between the target governor lever position value Nro previously calculated and stored in a memory, a rotational speed variation ΔNr predetermined as a variation in the engine speed and a predetermined minimum engine speed Nrmin is examined, that is, a determination is made as to whether or not $$Nro-\Delta Nr>Nrmin$$

If YES, Nro−ΔNr is stored in the memory as a new target governor lever position value Nro in step S8. If Nro−ΔNr ≦Nrmin, the process proceeds to step S7, and Nrmin is stored in the memory as a new target governor lever position value Nro.

If NO as a result of determination in step S2, determination is made in step S3 as to whether or not signal UP exists. If YES, determination is made in step S9 as to whether or not $$Nro+\Delta Nr<Nrmax$$

with respect to the target governor lever position value Nro, the rotational speed variation ΔNr and the predetermined maximum engine speed Nrmax. If YES, Nro+ΔNr is stored in the memory as a new target governor lever position value Nro in step S11. If Nro+ΔNr≧Nrmax, Nrmax is stored in the memory as a new target governor lever position value Nro in step S10.

In step S4, the target governor lever position value Nro obtained in step S7, S8, S10 or S11 is output to the arithmetic unit 12, and the process returns to the start.

Next, a process which is executed by the arithmetic unit 12 will be described below with reference to FIG. 4A. In this process, feedback control is performed to adjust the engine speed to the target value.

In step S21, the target governor lever position value Nro and the detected governor position value Nrp are read. In step S22, the result of calculation: Nrp−Nro is stored in a memory as a rotational speed difference A. In step S23, A is compared with a predetermined reference rotational speed difference K, that is, determination is made as to whether or not |A|≧K. If YES, the process proceeds to step S24, and determination is made as to whether or not A >0. If A>0, that is, the detected governor lever position Nrp is larger than the target governor lever position value Nro, in other words, the rotational speed to be controlled is higher than the target rotational speed, a signal which represents a command to rotate the motor in the reverse direction is output in step S25 in order to reduce the engine speed. If A≦0, that is, the detected governor lever position Nrp is smaller than the target governor lever position value Nro, in other words, the rotational speed to be controlled is lower than the target rotational speed, a signal which represents a command to rotate the motor in the normal direction is output in step S26 in order to increase the engine speed. If NO in step S23, the process proceeds to step S27, and a motor stop signal is output. After steps S25 to S27 have been executed, the process returns to the start.

In accordance with this process, the engine speed is controlled as described below.

1. A case where up switch $6_U$ or down switch $6_D$ is rapidly turned on and off one time only.

If the up switch $6_U$ is rapidly turned on and off one time, a pulse-like signal UP is output from the up switch $6_U$. The arithmetic unit 11 thereby executes step S9 one time, and the target governor lever position value Nro increased by ΔNr from the preceding value calculated and stored in the memory is supplied to the arithmetic unit 12, in a case where Nro+ΔNr is not larger than the maximum rotational speed Nrmax. If the difference |A| between the target governor lever position value Nro and the detected governor lever position value Nrp is equal to or larger than the reference rotational speed difference K and if A is negative, the normal motor rotation command signal is output from the arithmetic unit 12. When supplied with this normal motor rotation command signal, the motor drive circuit 13 sends the motor drive signal consisting of a pulse train having a predetermined frequency to the pulse motor 3 to rotate the same. The pulse motor 3 thereby rotates in the normal direction and drives the governor 1*a* through the link mechanism 2, thereby increasing the engine speed. The rotation of the pulse motor 3 is supplied as the detected governor position value Nrp to the arithmetic circuit 12. When the difference |A| between the target governor lever position value Nro and the detected governor lever position value Nrp becomes smaller than the reference rotational speed difference K during driving of the motor, the arithmetic unit 12 outputs the motor stop signal. When supplied with this motor stop signal, the motor drive circuit 13 stops outputting the motor drive signal, thereby stopping the pulse motor 3.

In a case where the down switch $6_D$ is rapidly turned on and off one time, the engine speed is reduced in a similar manner.

2. A case where up switch $6_U$ or down switch $6_D$ is maintained in the on state for a predetermined period of time.

If the up switch $6_U$ is maintained in the on state for a predetermined period of time, the high level signal UP is output for the corresponding period of time. The arithmetic unit 11 executes the process of FIG. 3A a plurality of times (Q times) within the period of time when the signal UP is high level. The target governor lever position value Nro changes as represented by Nro+QΔNr. If this value is smaller than Nrmax. Nro+QΔNr is stored in the memory as a new target governor lever position value Nro and is supplied to the arithmetic unit 12. The arithmetic unit 12 continues outputting the motor normal rotation command signal to the motor drive circuit 13, as in the above, until $|A| \geqq K$ is negated.

During this continuous operation, the engine speed can be increased to the target value while the target governor lever position value Nro is successively updated by the arithmetic unit 11, on condition that the engine speed increase response time is shorter than the period of time in which the process of FIG. 3A is conducted one time. That is, in this case, the engine speed increases to the target value substantially simultaneously with the end of the operation of the up switch $6_U$. If the engine speed increase response time is longer than the period of time in which the process of FIG. 3A is conducted one time, the engine speed cannot be increased by following the operation of successively updating the target governor lever position value Nro, and the engine speed is increased to the target value represented by Nro+QΔNr even after the operation of the up switch $6_U$ is stopped.

The reference rotational speed difference K is determined on the basis of the resolution of the pulse motor 3 to be a certain value larger than a variation in the engine speed per one pulse supplied to the pulse motor 3, thereby preventing hunting of the engine speed.

Second Embodiment

A second embodiment has a well-known engine control modes, i.e., a power mode, an economy mode and a light mode. As shown in FIG. 2, a power mode switch $7_P$, an economy mode switch $7_E$ and switch a light mode switch $7_L$ are provided. A power mode signal, an economy mode signal and a light mode signal (which are called mode changeover signals) are supplied from the respective switches to the arithmetic unit 11. These switches constitute a set rotational speed command means.

Control of a machine in accordance with this embodiment which may be conducted as in the case of a type of system disclosed in, for example, Japanese Patent Laid-Open No. 62-99524 will be explained below.

An engine and a hydraulic pump are made operable in each of three modes: power mode, economy mode and light mode. In the power mode corresponding to a range of operation for high-load traveling or heavy excavation, the maximum displacement of the pump is set to a smaller value and the engine is operated in a high rotational speed range. In the economy mode corresponding to a range of operation for small-load traveling or light excavation, the maximum displacement of the pump is set to a larger value and the maximum rotational speed of the engine is limited to a speed lower than the rotational speed in the power mode. In the light mode corresponding to a range in which the engine needs to be finely controlled, the maximum displacement of the hydraulic pump is set to the same value as the economy mode but the engine speed is limited to a much lower speed. This selection of the maximum displacement of the pump and the engine speed enables the construction machine to be operated by selecting the optimum engine speed and the optimum pump absorption horsepower, thereby reducing the fuel consumption rate as well as limiting engine noise.

Figure 4A:
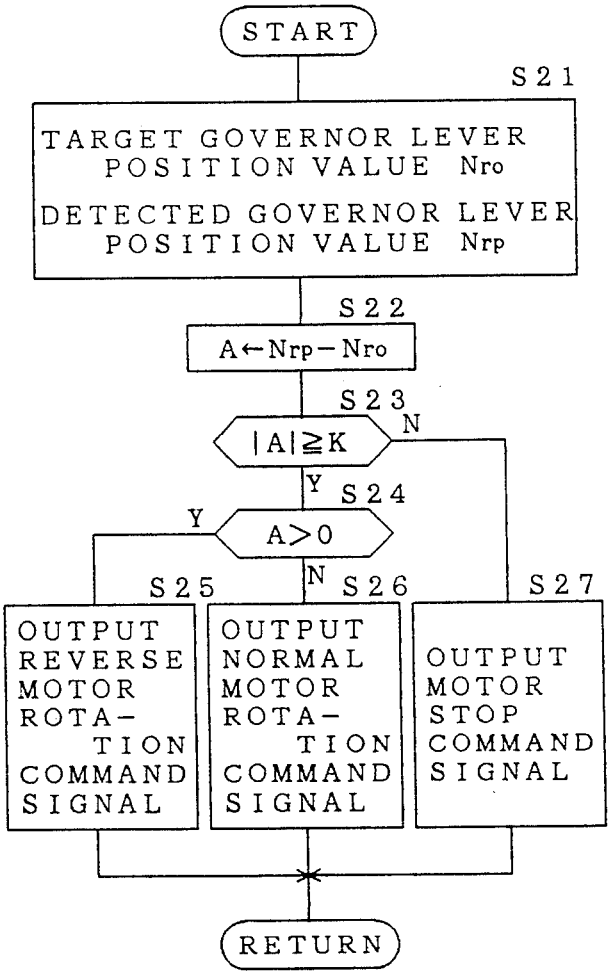

A process which is executed by the arithmetic unit 12 of this embodiment is the same as that in accordance with the flow chart of FIG. 4A. A process executed by the arithmetic unit 11 alone will be described below with reference to FIG. 5. Steps of the process shown in FIG. 5 corresponding to those shown in FIG. 3A are designated with the same reference characters, and the description for them will not be repeated.

Figure 5:
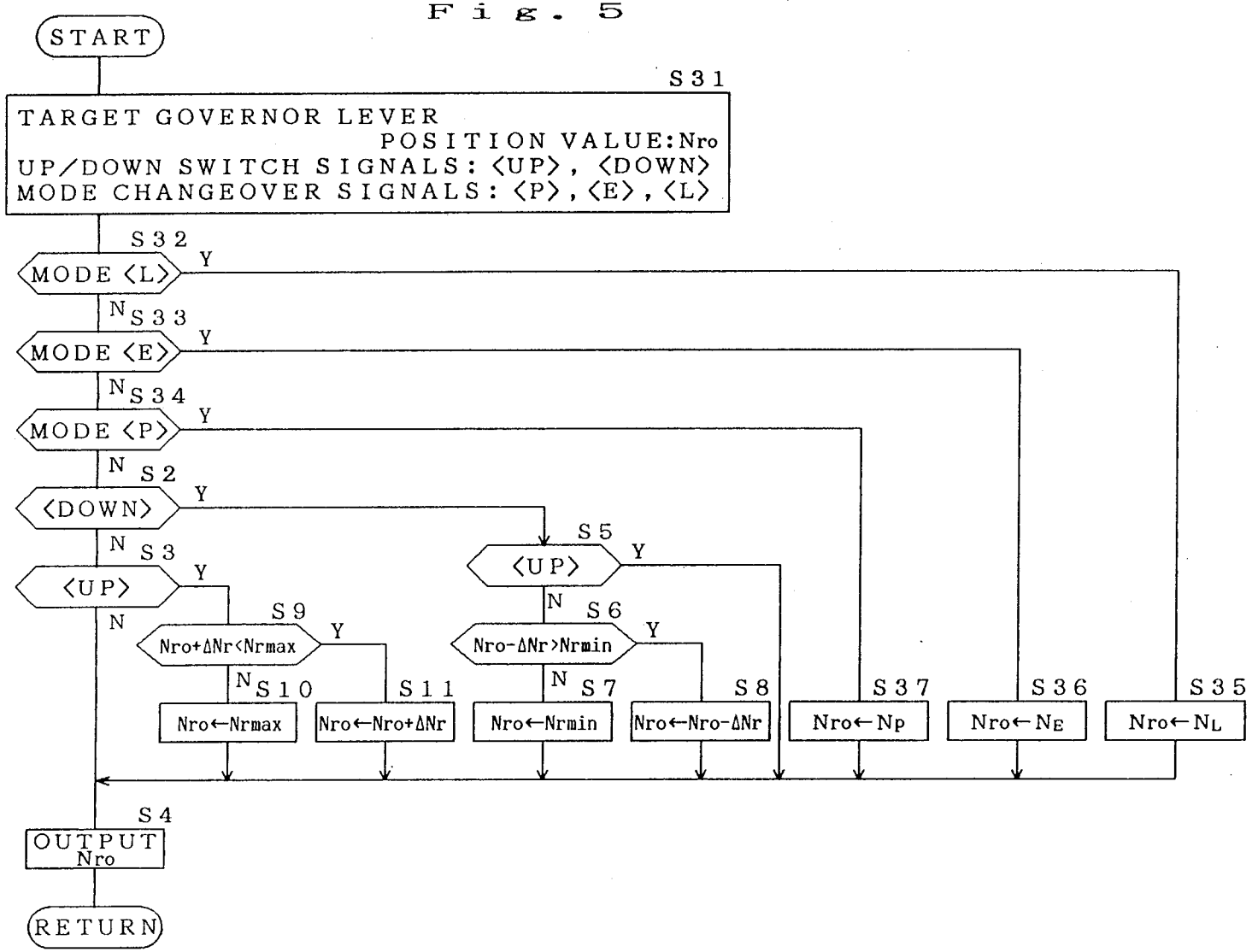
FIG. 5 is a flow chart of a process executed by the arithmetic unit 11 in accordance with a second embodiment of the present invention.

In step S31 of the process shown in FIG. 5, the target governor lever position value Nro, signal UP or DOWN and one of the three mode changeover signals are read. In step S32, determination is made as to whether or not the light mode is selected. If YES, the process proceeds to step S35 and a light mode rotation speed $N_L$ previously set with respect to the light mode is stored in a memory for the target governor lever position value Nro. If NO in step S32, determination is made in step S33 as to whether or not the economy mode is selected. If YES in step S33, the process proceeds to step S36 and an economy mode rotation speed NE ($>N_L$) previously set with respect to the economy mode is stored in the memory for the target governor lever position value Nro. If NO in step S33, the process proceeds to step S34 and determination is made as to whether or not the power mode is selected. If YES in step S34, the process proceeds to step S37 and a power mode rotation speed $N_P$ ($>N_E$) previously set with respect to the power mode is stored in the memory for the target governor lever position value Nro. That is, when one of the mode changeover signals is output, the target governor lever position value Nro which designates the corresponding one of the light mode rotation speed $N_L$, the economy mode rotation speed $N_E$ and the power mode rotation speed $N_P$ is input from the arithmetic unit 11 into the arithmetic unit 12 in step S4. The process of the arithmetic unit 12 is the same as the first embodiment and therefore will not be described again.

In case where none of the mode changeover signals is output, steps S2 to S11 are executed in accordance with the signal UP or DOWN from the up switch $6_U$ or the down switch $6_D$ in the same manner as the first embodiment. Therefore the description for these steps will not be repeated.

If, in the above process, the up switch $6_U$ or the down switch $6_D$ and one of the three mode switches are simultaneously operated, the mode changeover signal is received with priority to the signal UP or DOWN. Among the mode changeover signals, the light mode signal has the first priority and the economy mode signal has the second priority.

In the thus-arranged embodiment, the engine speed can be immediately changed into the predetermined speed of each mode by only one operation of the power mode switch $7_P$, the economy mode switch $7_E$ or the light mode switch $7_L$, thus solving a problem entailed by the use of the up switch $6_U$ and the down switch $6_D$, i.e. the problem of the time taken to set the target engine speed being unnecessarily long. The provision of the up switch $6_U$ and the down switch $6_D$ enables each of the rotational speeds $N_L$, $N_E$, and $N_P$ in the respective modes to be finely changed and hence to be readily adjusted to the optimum rotational speed for a particular operation. The above-mentioned type of mode selection system disclosed in Japanese Patent Laid-Open No. 62-99524 is designed to limit the maximum engine speed to a value suitable for each mode. In this system, it is difficult for the operator to change the maximum engine speed as he wishes. In accordance with the second embodiment of the present invention, however, the engine speed can be changed as desired on the basis of the rotational speeds in the respective modes $N_L$, $N_E$, and $N_P$ in order to select the optimum rotational speed according to working conditions, thereby enabling a further improvement in the fuel consumption rate and a reduction in noise and limiting exhaustion of smoke.

Third Embodiment

Figure 6:
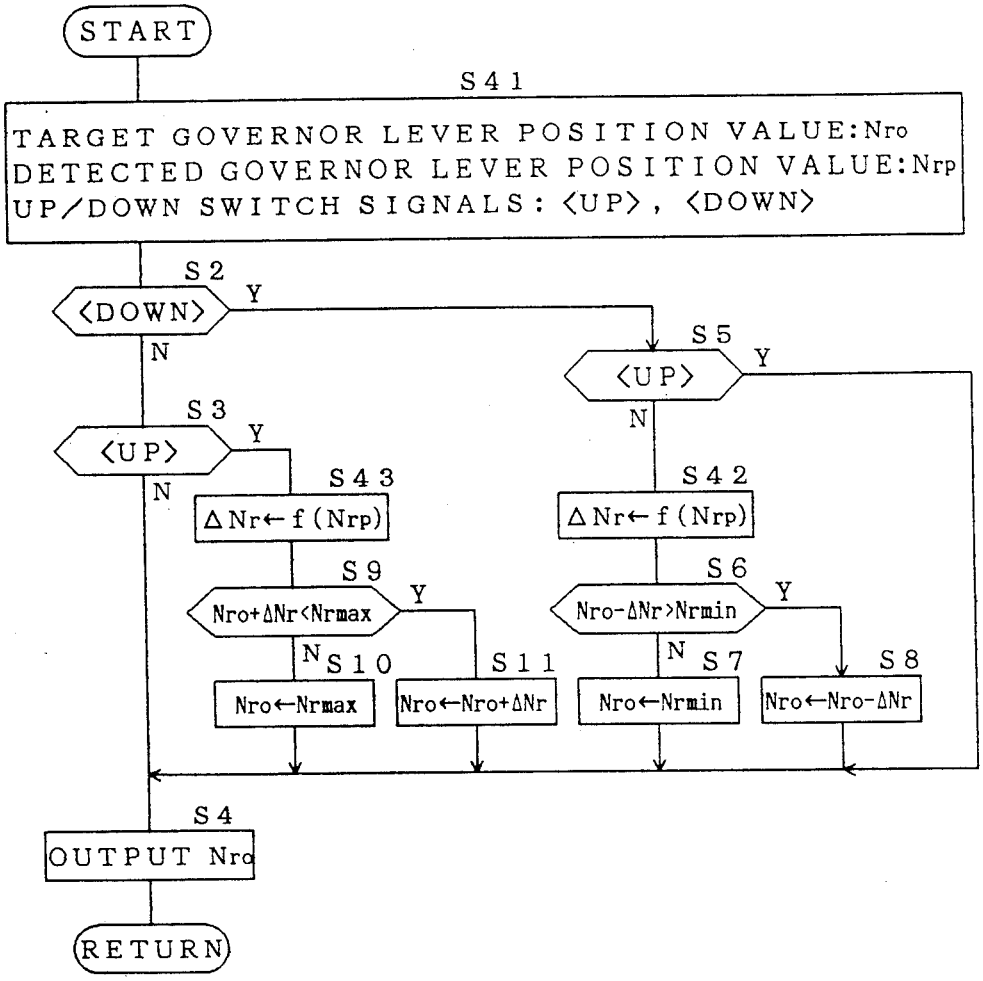
FIGS. 6, 8, and 10 are flow charts of three processes executed by the arithmetic unit 11 in accordance with a third embodiment of the present invention.

In a third embodiment, the rotational speed variation ΔNr can be changed according to the detected governor position value Nrp, i.e., the present engine speed control value. In FIG. 6 illustrating this third embodiment, steps corresponding to those shown in FIG. 3A are designated with the same reference characters, and the difference between the first and third embodiments will be described below.

Figure 7A:
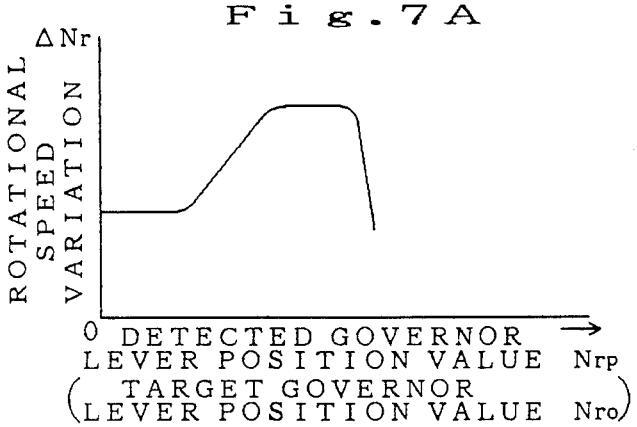
FIGS. 7A, 9A, and 11A are diagrams of tables for determining rotational speed variations in the third embodiment.

In step S41 of FIG. 6, the detected governor lever position value Nrp is read in addition to the target governor lever position value Nro and signal UP or DOWN. In step S42 or S43, the rotational speed variation ΔNr is read out from a predetermined table based on the graph of FIG. 7A in accordance with the thus read detected governor lever position value Nrp. From this rotational speed variation ΔNr, the target governor lever position value Nro is calculated in step S6, S8, S9, or S11. The table based on the graph of FIG. 7A is provided in the arithmetic unit 11.

In this embodiment, the engine speed is changed by the rotational speed variation ΔNr according to the detected governor lever position value Nrp, i.e., the present engine speed control value when the up switch $6_U$ or the down switch $6_D$ is operated. As a result, the engine speed is changed slowly in a low speed range in which a performance of finely controlling the rotational speed is needed, or the rotational speed variation in response to the operation of the up switch $6_U$ or the down switch $6_D$ is increased in a high speed range in which there is no need for fine speed control, thus improving the operability The table based on the graph of FIG. 7A may be provided as software in the arithmetic unit 11 to make it easy to achieve engine speed control according to the user's desire by changing this table. The rotational speed variation ΔNr may be changed according to the target governor lever position value Nro.

Figure 9A:
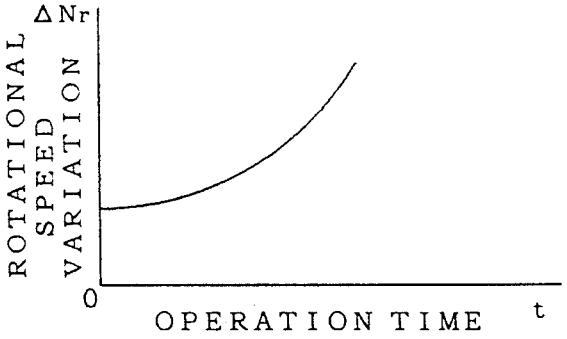
Figure 8:
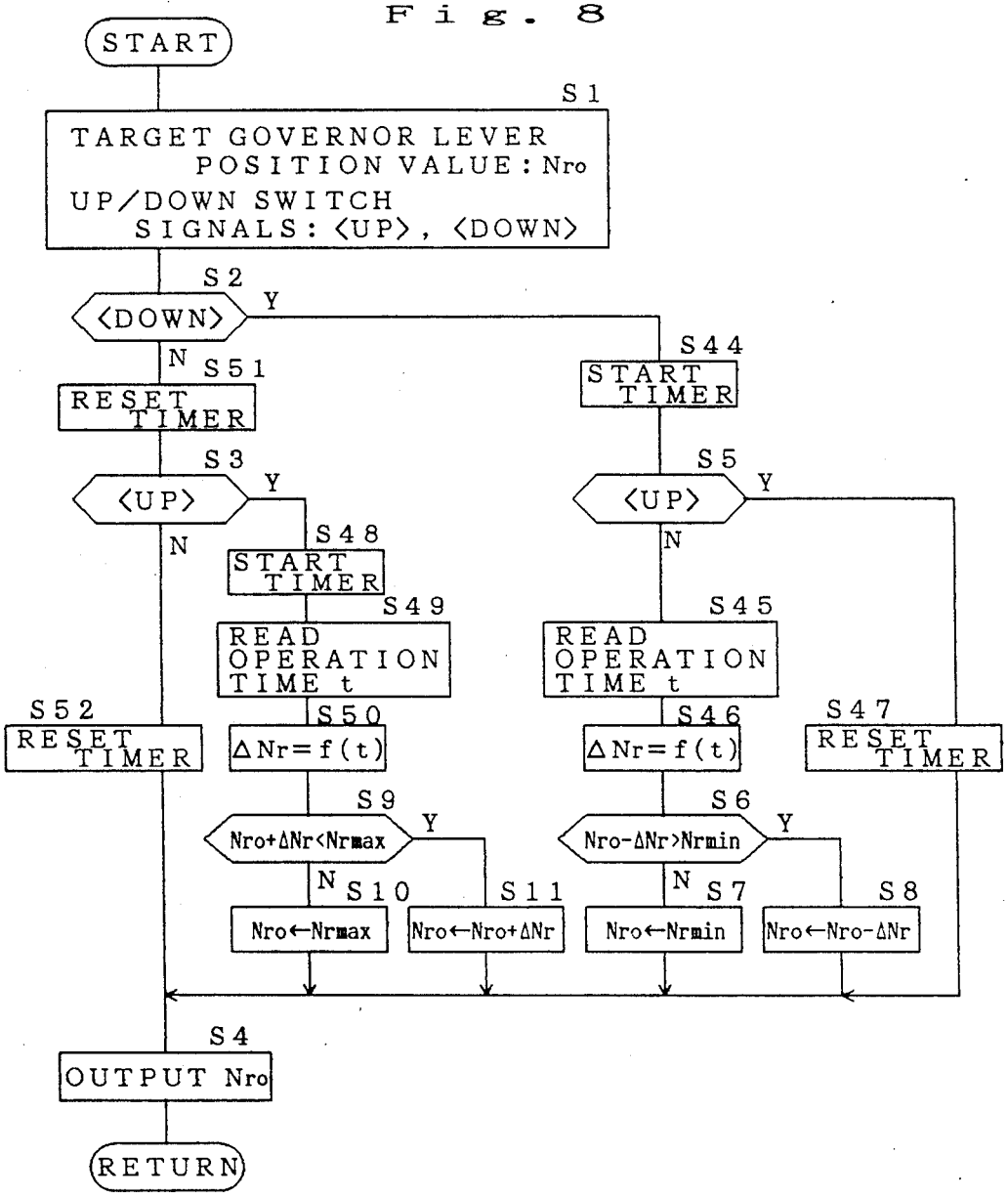

The rotational speed variation ΔNr may also be changed according to the period of time t when the up switch $6_U$ or the down switch $6_D$ is operated, as shown in FIG. 8 and FIG. 9A.

That is, as shown in FIG. 8, the period of time t when the up switch $6_U$ or the down switch $6_D$ is depressed is measured with an unillustrated timer (in steps, S44, S45, S48, and S49), the rotational speed variation ΔNr is read from a table based on the graph of FIG. 9A according to the time t (steps S46 and S50), and the target governor lever position value Nro is calculated from ΔNr and is output, as in the above. When the operation of the the up switch $6_U$ or down switch $6_D$ is stopped, the timer is reset in steps S51 and S52.

In accordance with this embodiment, even if ΔNr is set to a smaller value in order to improve the finely controlling performance (to minimize the change in the engine speed created by rapidly operating the switch one time), ΔNr becomes larger if the period of time when the up switch $6_U$ or the down switch $6_D$ is operated is increased, thereby maintaining the desired operability for changing the rotational speed to a large extent. In addition, the follow-up performance of the operation of increasing the engine speed after the up switch $6_U$ or the down switch $6_D$ has been operated can be improved.

Figure 11A:
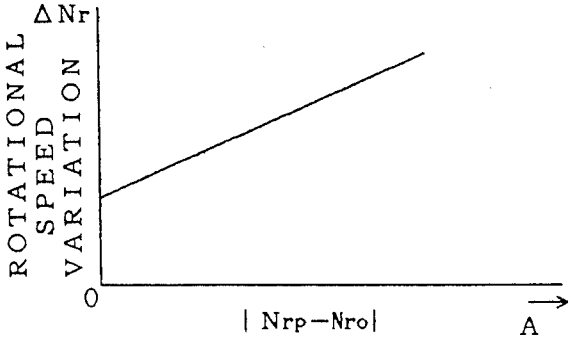
Figure 10:
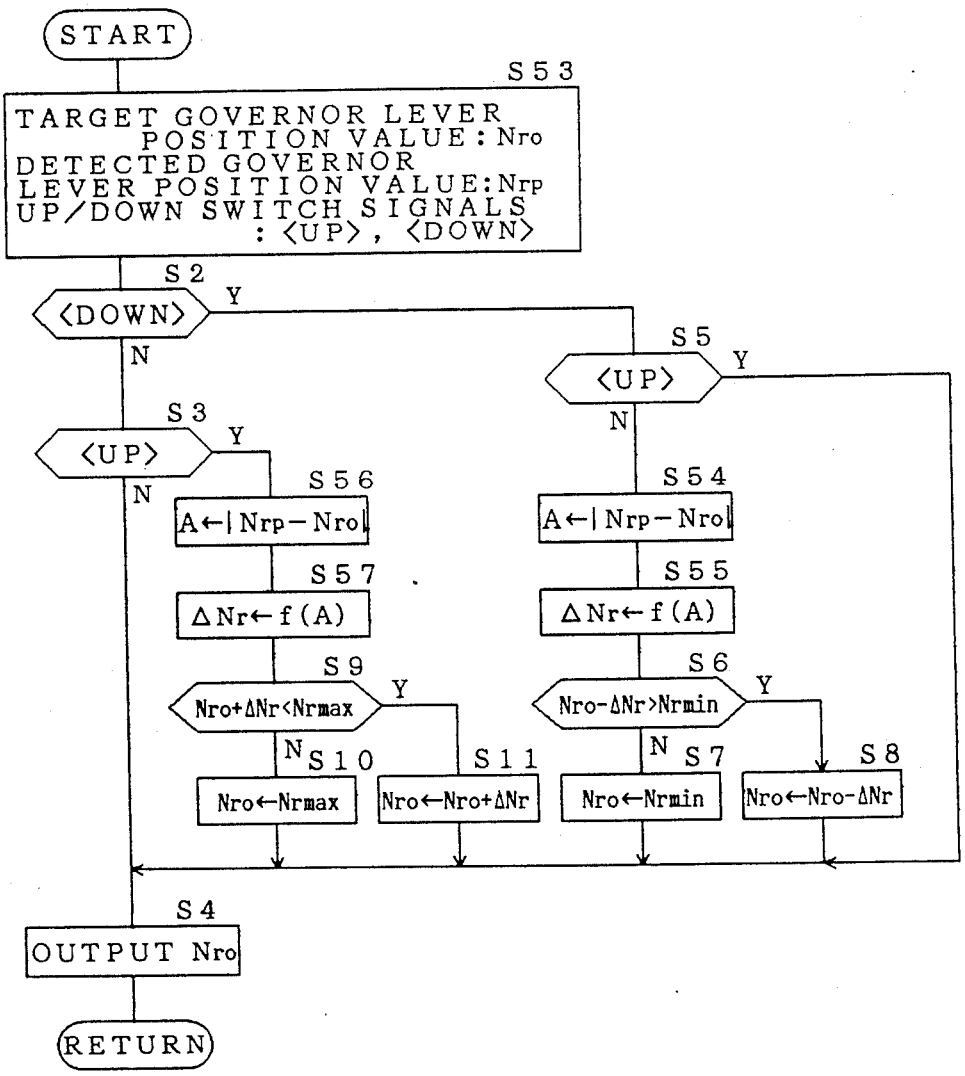

The rotational speed variation ΔNr may also be changed according to the difference A between the target governor lever position value Nro and the detected governor lever position value Nrp, as shown in FIG. 10 and FIG. 11A.

That is, as shown in FIG. 10, the target governor lever position value Nro, the detected governor lever position value Nrp, and signals UP or DOWN are read in step S53, the difference A between the target governor lever position value Nro and the detected governor lever position value Nrp is calculated in step S54 or S56, and the rotational speed variation ΔNr according to the difference A between Nro and Nrp is read from a table based on the graph of FIG. 11A. The target governor lever position value Nro is calculated from ΔNr and is output from the arithmetic unit 11, as in the above.

In accordance with this embodiment, the rotational speed variation ΔNr per one operation of the up switch $6_U$ or the down switch $6_D$ if the difference A between the target governor lever position value Nro and the detected governor lever position value Nrp, i.e., the difference between the target rotational speed and the present rotational speed to be controlled is increased. That is, if the difference becomes larger, the engine speed is changed at a higher rate, and if the difference becomes smaller, the engine speed is changed at a smaller rate. As a result, the follow-up performance of the operation of changing the engine speed after the up switch $6_U$ or the down switch $6_D$ has been operated can be improved, and it is possible to prevent overshooting because the rate at which the engine speed is changed becomes smaller as the engine speed becomes closer to the target value.

In these arrangements, ΔNr and, hence, the rate at which the engine speed is changed is increased if the target governor lever position value Nro or the detected governor lever position value is larger, if the period of time when the up switch $6_U$ or the down switch $6_D$ is operated is longer, or if the difference A between the target governor lever position value Nro and the detected governor lever position value Nrp is larger, on condition that the speed of response of the servo system constituted by the arithmetic unit 12, the motor drive circuit, the pulse motor 3 and the potentiometer 5 is high enough to follow up updating of the target governor lever position Nro effected by the arithmetic unit 11. If the response speed of the servo system is not high enough to follow up updating of the engine drive signal effected by the control circuit 10, the frequency of pulses supplied to the pulse motor 3 may be increased according to the above-described conditions to increase the rate at which the engine speed is changed.

Figure 7B:
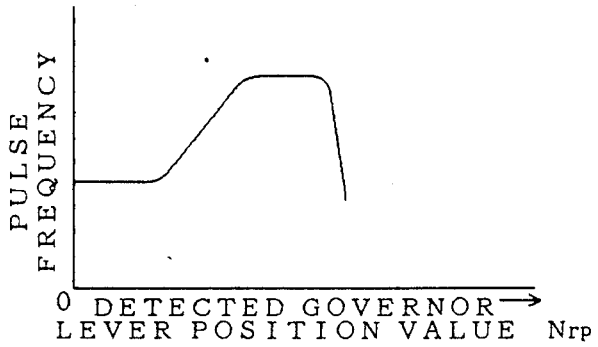
FIGS. 7B, 9B, and 11B are diagrams of tables for determining rotational speed variations in different ways.
Figure 9B:
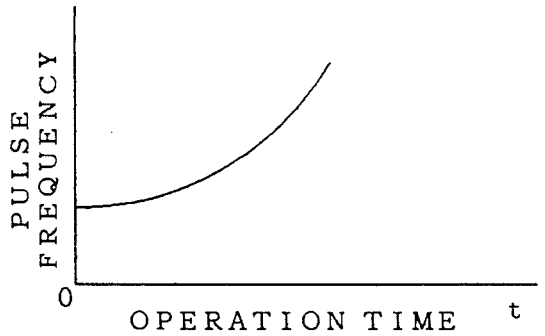
Figure 11B:
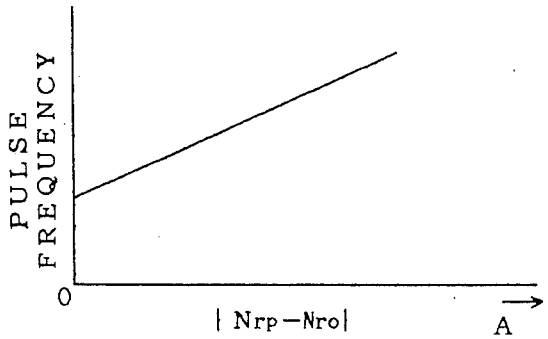
Figure 12:
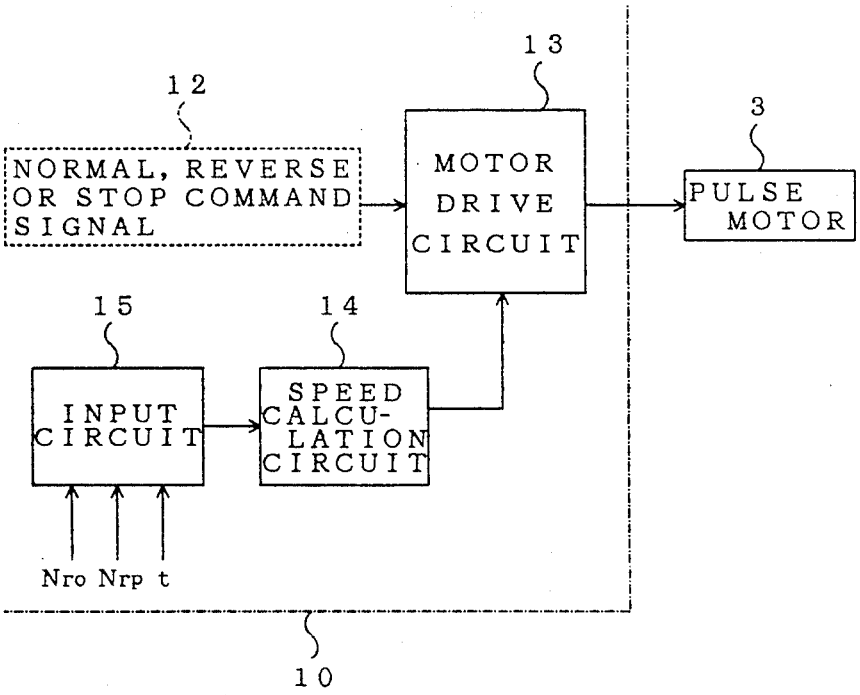
FIG. 12 is a block diagram of essential portions of a control circuit which represents a modification of the third embodiment.

FIG. 12 shows a circuit arrangement for changing the frequency of pulses for driving the pulse motor 3. As shown in FIG. 12, a speed calculation circuit 14 is connected to the motor drive circuit 13. The speed calculation circuit 14 calculates the frequency of the pulse train supplied to the pulse motor 3 according to, for example, 1 the target governor lever position value Nro or the detected governor lever position value Nrp supplied via an input circuit 15, 2 the period of time when the up switch $6_U$ or the down switch $6_D$ is operated, or 3 the difference A between the target governor lever position value Nro and the detected governor lever position value Nrp, and instructs the motor drive circuit 13 to output the pulse train at the calculated frequency. That is, the frequency of the pulse train is increased in order to increase the rotational speed of the pulse motor 3 and, hence, the rate at which the engine speed is changed, if the target governor lever position value Nro or the detected governor lever position value Nrp is larger, if the period of time when the up switch $6_U$ or the down switch $6_D$ is operated is longer or if the difference A is larger. For this process also, tables in which the pulse motor driving frequency is changed with respect to Nrp, Nro, t or A, as shown in FIGS. 7B, 9B and 11B can be used.

This arrangement also ensures the same effects as those described above.

Fourth Embodiment

Figure 13:
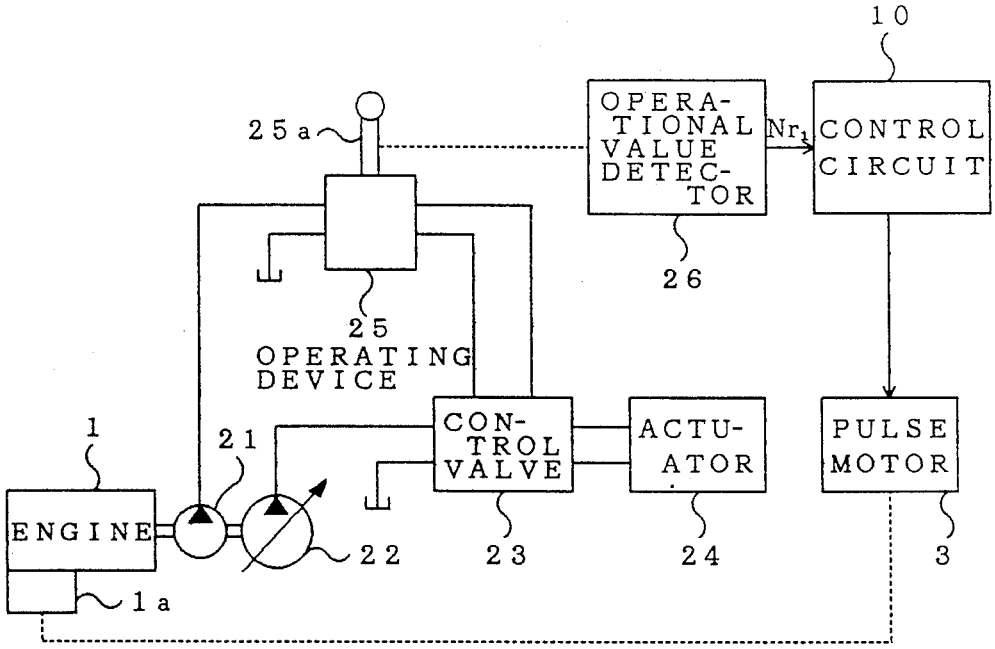
FIG. 13 is a hydraulic circuit in accordance with a fourth embodiment of the present invention.

A fourth embodiment is applied to a working machine having a hydraulic control system such as that shown in FIG. 13 and is designed to enable the engine speed to be also controlled on the basis of a value which represents the operation of an operating device for operating an actuator for excavation attachment or for traveling.

Figure 14:
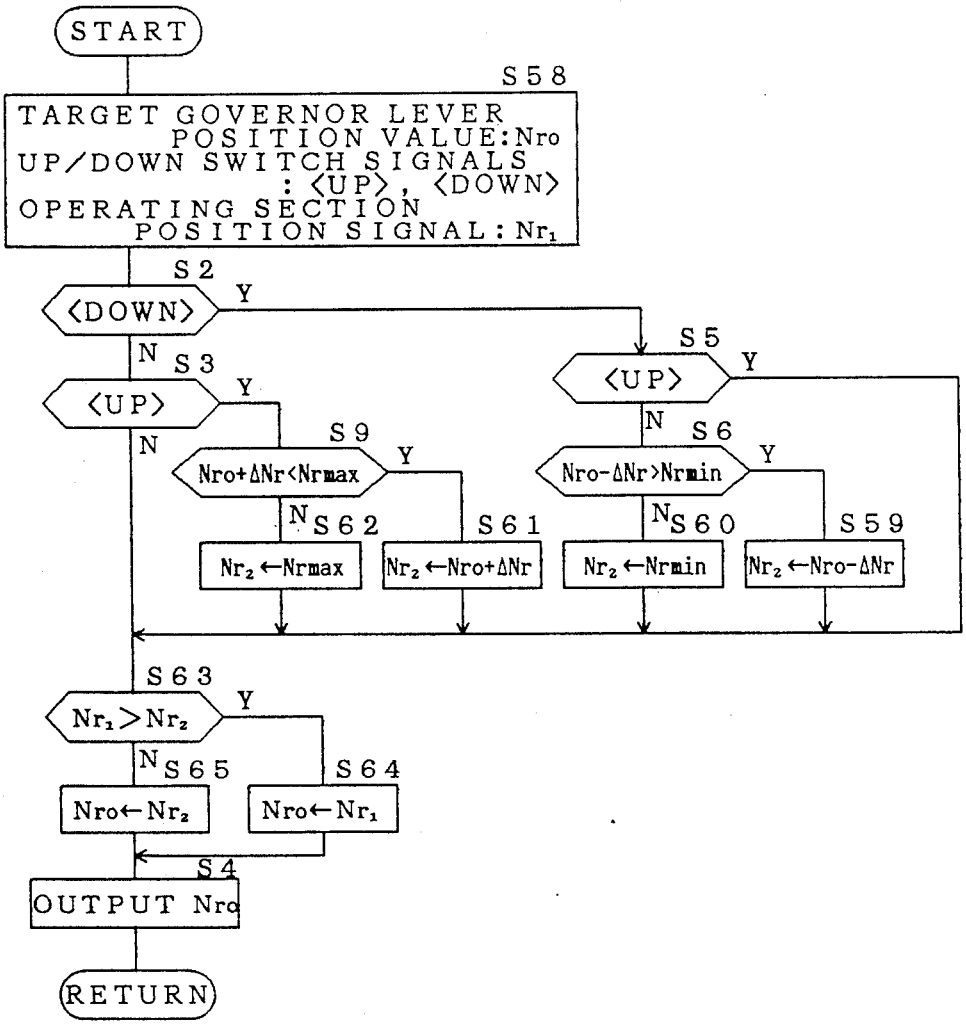
FIG. 14 is a flow chart of a process executed by the arithmetic unit 11 in accordance with the fourth embodiment.

In FIG. 13, components corresponding to those shown in FIG. 2 are designated with the same reference characters. A pilot hydraulic pump 21 and a variable displacement hydraulic pump 22 are driven by the engine 1. Oil discharged from the variable displacement hydraulic pump 22 is controlled by a control valve 23 with respect to the direction of its flow and the flow rate and is introduced into an actuator 24 to drive the same. The pressure of oil discharged from the pilot hydraulic pump 21 is set by a proportional decompression valve type cf operating device 25 to a level corresponding to a value representing the operation of a lever **25*a* of this device, and this oil is led to a pair of pilot ports of the control valve 23 to control changeover operation of this valve. The operational value of the operating lever 25*a* is detected by an operational value detector 26 constituted by a potentiometer or the like and is sent to the control circuit 10 as an operational section position signal $Nr_1$. The arithmetic unit 11 of the control circuit 10 executes a later-described process represented by the flow chart of FIG. 14, and calculates the target governor lever position value Nro for controlling the engine speed, thereby changing the engine speed in accordance with the operational value in an operating range of the operating lever 25*a* above a predetermined value. In FIG. 14, steps corresponding to those of FIG. 3A** are designated with the same reference characters, and the description for them will not be repeated.

The fourth embodiment will be described below in more detail with reference to FIG. 14.

In step S58, the operational section position signal value $Nr_1$ is read from the operational value detector 16 together with the target governor lever position value Nro and signals UP or DOWN. In steps S59 to S62, the result of calculation of the target rotational speed effected in the same manner as steps S7, S8, S10, and S11 of FIG. 3A is stored as a new target rotational speed $Nr_2$ in a memory. In step S63, the operational section position signal value $Nr_1$ and the target rotational speed $Nr_2$ are compared with each other. If $Nr_1 \geqq Nr_2$, he operational section position signal value $Nr_1$ is stored in the memory for the target governor lever position value Nro in step S64. If $Nr_1 \leqq Nr_2$, the target rotational speed $Nr_2$ is stored in the memory for the target governor lever position value Nro. In step S4, the target governor lever position value Nro is output to the arithmetic unit 12.

That is, in this embodiment, the larger one of the target governor lever position value Nro determined by the up switch $6_U$ or the down switch $6_D$ and the operational section position signal $Nr_1$ determined by the operation of the operating lever **25*a* is supplied as the target governor lever position value Nro to the arithmetic unit 12**, thereby achieving the following effects:

1. Within an operating range of the operating lever **25*a* above a predetermined value, the rotational speed can be set by the operational value detector 26** according to working conditions after the desired minimum rotational speed has been set by the up switch $6_U$ or the down switch $6_D$, resulting in a reduction in the fuel consumption and an improvement in the operability of the machine; and
2. Within an operating range below the rotational speed set by the up switch $6_U$ or the down switch $6_D$, variations in the engine speed can be reduced because there is no change in the rotational speed created by the output from the operational value detector 26, thereby preventing any increase in the fuel consumption and occurrence of smoke exhaustion and noise which may be caused by such variations.

The operating range of the operating lever 25a above a predetermined value may be detected with a potentiometer in order to control the engine speed with respect this range. The extent of operation of the operating lever may be detected by a pressure sensor capable of detecting the pressure produced by the operation of the operating lever. <Modified example of the process of calculating target governor lever position value Nro with arithmetic unit 11>.

The above-described procedure of processing in the arithmetic unit 11 is designed to obtain the target governor lever position value Nro when the up switch $6_U$ or the down switch $6_D$ is operated during rotation of the engine. In a case where the engine is started by being rotated at a predetermined start rotation speed, a process in accordance with the flow chart of FIG. 3B or 3C may be used.

Figure 3B:
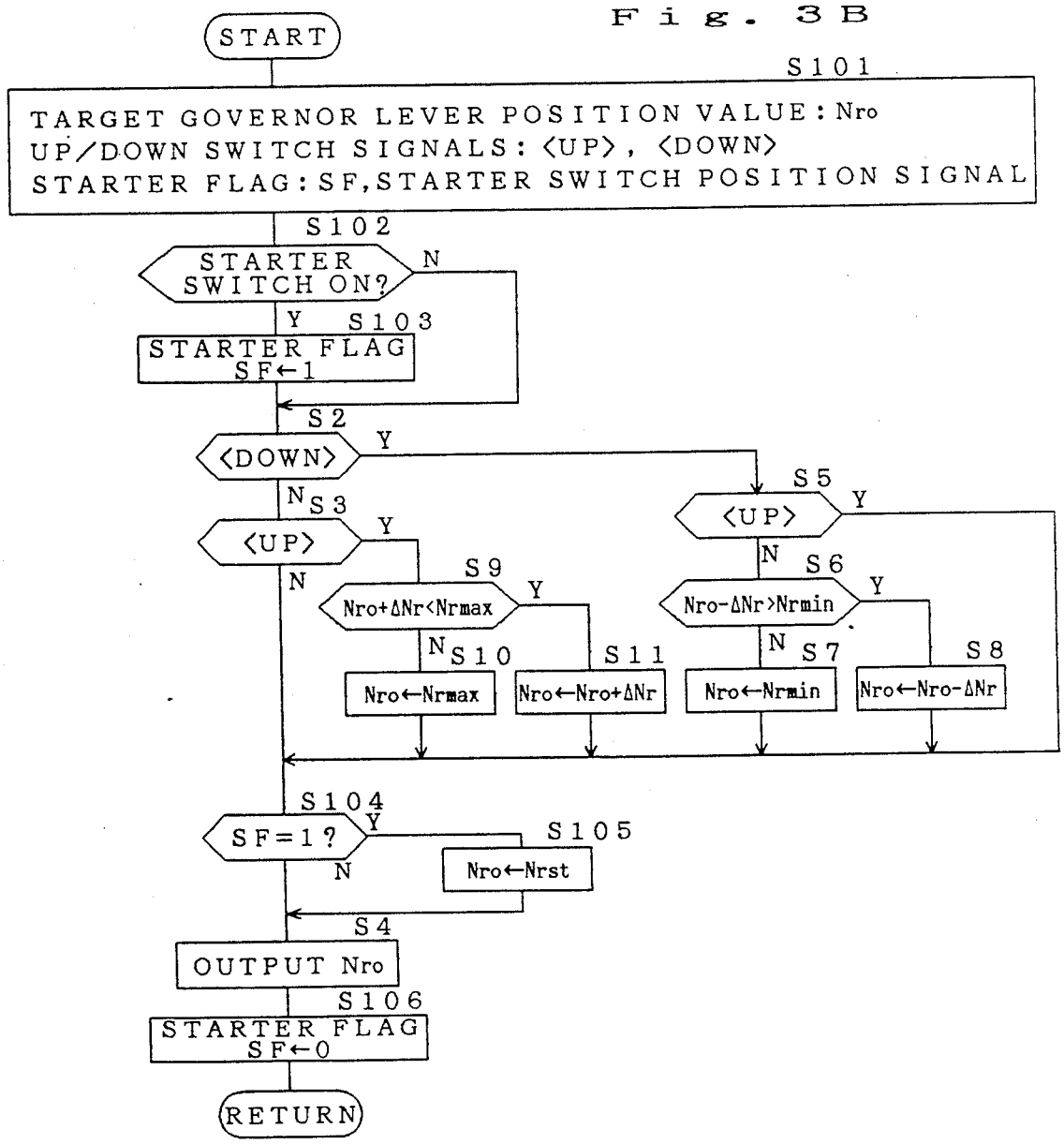
FIGS. 3B and 3C are flow charts of other examples of the process executed by the arithmetic unit 11.
Figure 3C:
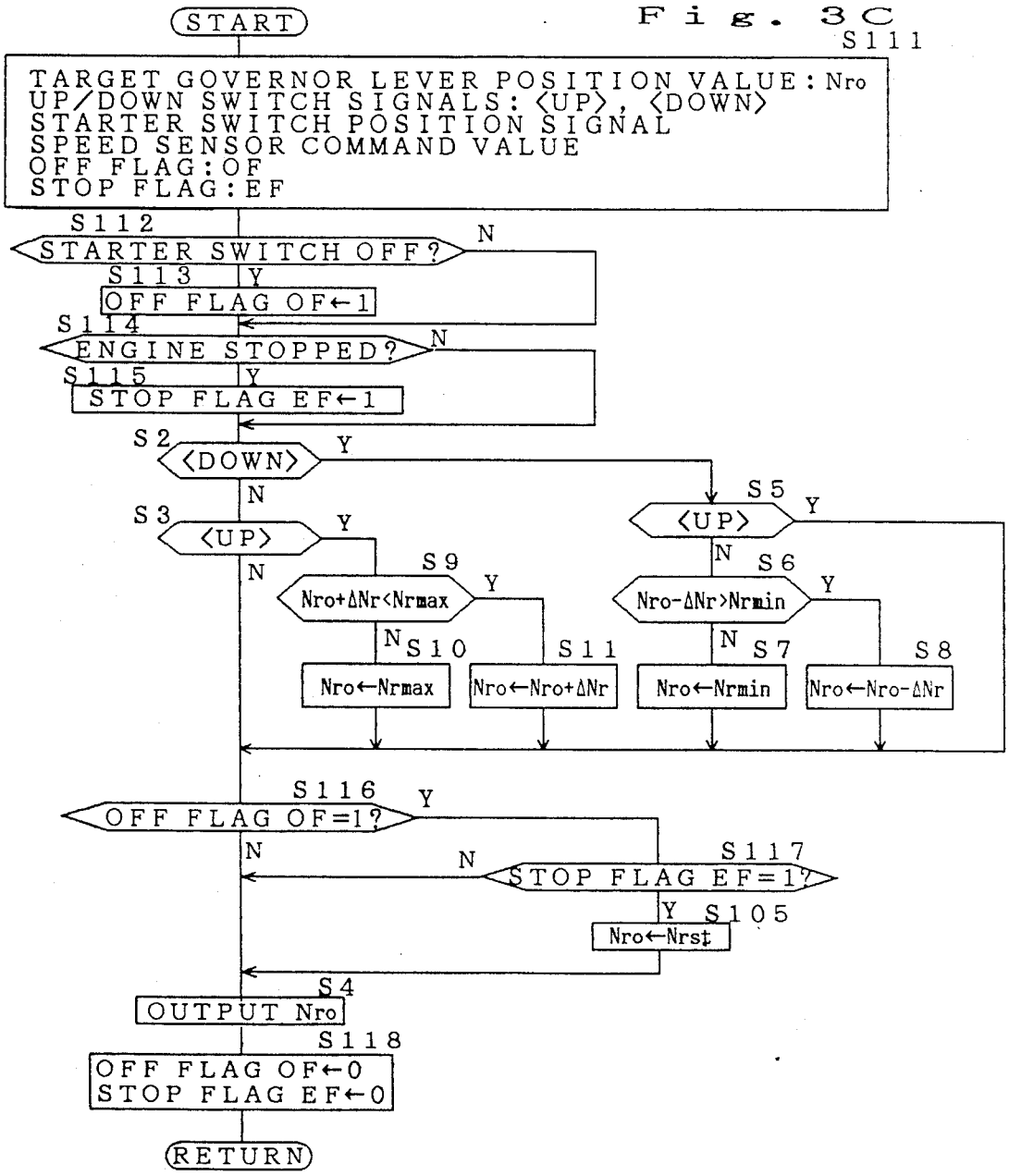

The processes of FIGS. 3B and 3C are similar to that of FIG. 3A but necessitate operations of a starter switch 8 for starting an unillustrated starter motor and a rotational speed sensor 9 for outputting a signal corresponding to the actual speed of rotation of the engine 1, as shown in FIG. 2. These components are connected to the input circuit 111 of the arithmetic unit 11. The starter switch 8 can be changed over between a starting position for connection of the power source to the starter motor, an on position to which it is automtically returned after the engine has been started to enable connection to a load other than the starter motor, and an off position at which the power source is shut off from all loads except for the control circuit 10. A starter switch position signal from the starter switch 8 is switched on at the starting position, and is switched off at the on or off position.

In the process of FIG. 3B, a start rotation speed Nrst is set as the target governor lever position value Nro at the time of starting of the engine.

In step S101, the target governor lever position value Nro, up/down switch signals UP or DOWN, starter flag SF and the starter switch position signal are read. In step S102, determination is made as to whether or not the starter switch has been set to the starting position. If the starter switch has been set to the starting position, the starter flag SF is set to 1 in step S103, and the process proceeds to step S2. The process of the succeeding steps S2 to S11 is the same as the process of FIG. 3A. If none of signals UP and DOWN is supplied, determination is made in step S104 as to whether or not the starter flag SF is 1. If the flag is 1, the process proceeds to step S105, and the predetermined start rotation speed Nrst is set as the target governor lever position value Nro. Thereafter, in step S4, the thus-obtained Nro is supplied to the arithmetic unit 12. In step S106, the starter flag SF is set to 0 and the process returns to the start.

After the engine has been started, the starter switch 8 is returned to the on position, and the starter switch signal is therefore switched off. The process therefore proceeds to step S2 by skipping step S103. Correspondingly, the result of step S104 is NO, and Nro calculated in one of steps S7, S8, S10, and S11 is output in step S4 in a case where the up switch $6_U$ or the down switch $6_D$ is operated after the engine has been started.

In the process of FIG. 3C, the start rotation speed Nrst is set as the target governor lever position value Nro in response to stoppage of the engine.

In step S111, the target governor lever position value Nro, signal UP or DOWN are read as described above and, at the same time, start switch off flag OF, engine stop flag EF, the starter switch position signal, and rotational speed sensor indication value are read. In step S112, determination is made as to whether or not the starter switch 8 is in the off position, i.e., whether or not the starter switch position signal is off. If the signal is off, the starter switch off flag OF is set to 1 in step S113. In step S114, determination is made as to whether or not the engine 1 has been stopped on the basis of whether or not the engine speed sensor 9 outputs any signal. If the engine 1 has been stopped, the engine stop flag EF is set to 1 in step S115. The process thereafter proceeds to step S2.

The process of the succeeding steps S2 to S11 is the same as the process of FIG. 3A. In step S116, determination is made as to whether or not the starter switch off flag OF is 1. If the flag is 1, the process proceeds to step S117, and determination is made as to whether or not the engine stop flag EF is 1. If this flag is 1, the start rotation speed Nrst is set as the target governor lever position value Nro. Thereafter, in step S4, the target governor lever position value Nro is output, thereby setting the governor to the start rotation speed position. Then, in step S118, both the starter switch off flag OF and the engine stop flag EF are set to 0, thus, completing the process.

In thus-arranged process based on the flow chart of FIG. 3C, the start rotation speed Nrst is set as the target governor lever position value Nro, and the governor lever position is set to the position corresponding to the start rotation speed Nrst, on condition that the starter switch 8 is in the off position and that the engine is stopped. Accordingly, the engine 1 rotates at the start rotation speed Nrst when thereafter started again.

Since, as shown in FIG. 3C, the start rotation speed Nrst is stored in the memory for the target governor lever position value Nro only when the starter switch position signal is off and the engine is stopped, the target governor lever position value Nro calculated in step S7, S8, S10, or S11 during rotation of the engine is maintained even if the engine 1 is stopped while the starter switch 8 in the on position as in the case of engine stalling during operation. When started again, the engine 1 is controlled in accordance with the target governor lever position value Nro thus maintained. In consequence, there is no need for resetting the lastly selected engine speed in the event of engine stalling, thus improving the operability.

In the process of FIG. 3C, it is necessary to store the start rotation speed Nrst as Nro and to control the governor so as to set the same to the start rotation speed position when the starter switch 8 is turned off and when the engine 1 is stopped. The control circuit 10 is therefore supplied with power for a certain period of time even after the starter switch 8 has been turned off. Supply of power to the control circuit 10 is stopped after the predetermined operation has been completed.

The start rotation speed Nrst is not necessarily set to the idling speed and may be set to a speed higher than the idling speed. For example, it may be set to 1000 r.p.m. when the idling speed is 850 r.p.m.

<Engine speed control based on feedforward control>

Figure 4B:
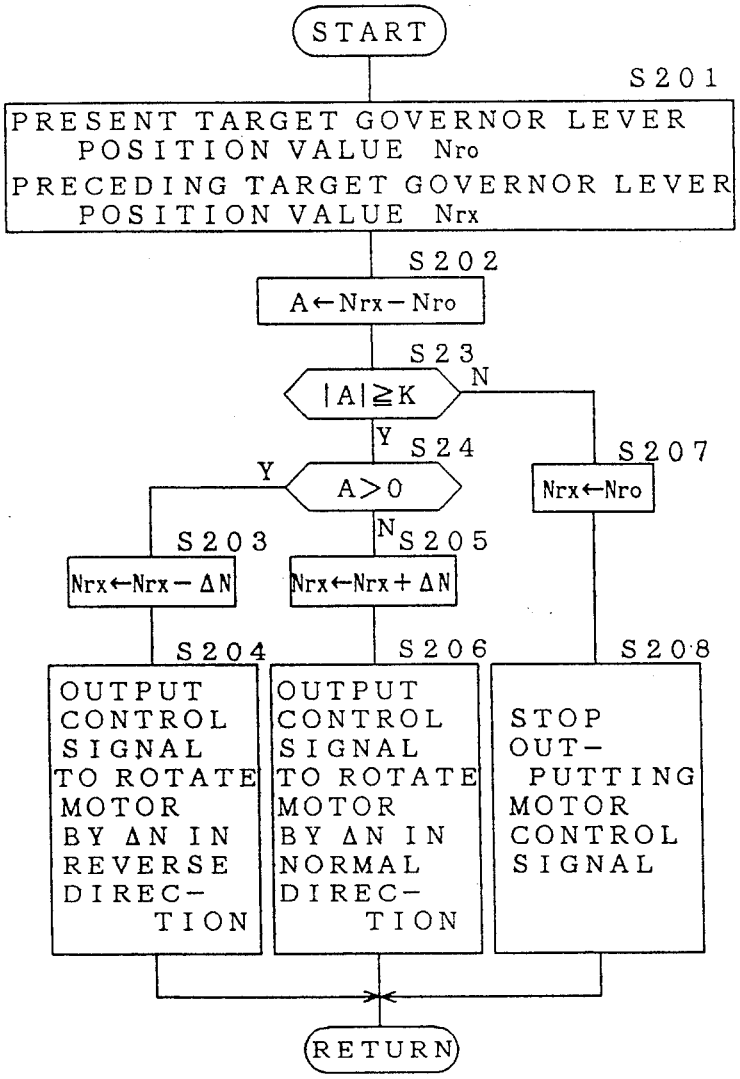
FIG. 4B is a flow chart of a rotational speed control process based on feedforward control.

The above-described process in accordance with the flow chart of FIG. 4A is based on feedback control for adjusting the engine speed to the target value. However, the engine speed may be controlled in a feedforward control manner, as shown in FIG. 4B. In this case, the need for input of the detected governor lever position value Nrp into the arithmetic unit 12 is eliminated.

A process of performing feedforward control will be described below with reference to FIG. 4B in which steps corresponding to those shown in FIG. 4A are designated with the same reference characters.

In step S201, the present target governor lever position value Nro currently calculated by and supplied from the arithmetic unit 11, the preceding target governor lever position value Nrx calculated and used for engine speed control at the preceding time are read. Then, in step S202, a deviation A of the present target governor lever position value Nro from the preceding target governor lever position value Nrx is obtained. In step S23, determination is made as to whether or not the deviation A is larger than a predetermined value K. If YES in step S23, determination is made in step S24 as to whether the deviation A is positive or negative. If the deviation A is positive, the process proceeds to step S203 in which a predetermined rotational speed value ΔN is subtracted from the preceding target governor lever position value, and the result of this subtraction is set as a new preceding target governor lever position value Nrx. In step S204, a control signal for rotating the motor 3 in the reverse direction to make revolutions corresponding to the rotational speed value ΔN is supplied to the motor drive circuit 13, and the process returns to the start.

The rotational speed value ΔN corresponds to the number of steps by which the motor 3 is rotated to change the engine speed during execution of one loop.

If NO in step S24, ΔN is added to the preceding target governor lever position value Nrx, and the result of this addition is set as a new preceding target governor lever position value Nrx. Thereafter, in step S206, a control signal for rotating the motor 3 in the normal direction to make revolutions corresponding to the rotational speed value ΔN is supplied to the motor drive circuit 13, and the process returns to the start. If in step S208 the deviation A becomes smaller than the predetermined value, the process proceeds to step S207 and the present target governor lever position value Nro is stored as the preceding target governor lever position value Nrx. The motor is stopped in step S208.

Thus, in the feedforward control in accordance with the flow chart of FIG. 4B, the engine speed is controlled so that the deviation of the present target governor lever position value Nro from the preceding target governor lever position value Nrx becomes smaller than the predetermined value K. In the case of closed-loop control using a potentiometer 5, a malfunction of the rotation of the pulse motor 3 can be ascertained easily.

In this feed forward control, a pair of present and past target governor position values are used. However, the past data is not limited to the data obtained at the preceding time and it may be data of several times before.

Fifth Embodiment

Figure 15:
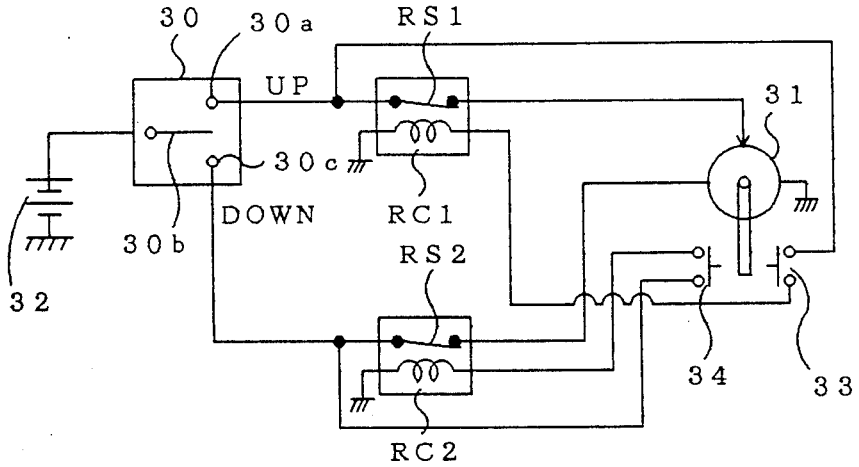
FIG. 15 is a diagram of a circuit in accordance with a fifth embodiment of the present invention.

FIG. 15 shows a fifth embodiment of the present invention.

An up-down switch 30 has an up terminal 30*a*, a movable contact 30*b* and a down terminal 30*b*. When the movable contact 30*b* is connected to the up terminal 30*a*, a battery 32 is connected to a normal direction input terminal of a DC motor 31 through a relay switch RS1, thereby rotating the DC motor 31 in the normal direction. While the up-down switch 30 is maintained for the connection through the up terminal 30*a*, the DC motor 31 continues rotating. When the DC motor 31 reaches the normal rotation end, a limit switch 33 is turned on and a relay coil RC1 is excited to open the relay switch RS1, thereby stopping the supply of power to the DC motor 31.

When the up-down switch 30 is connected to the down terminal 30*b*, a power current flows a relay switch RS2 to a reverse rotation input terminal of the DC motor 31, thereby rotating the DC motor 31 in the reverse direction. When the DC motor 31 reaches the reverse rotation end, a limit switch 34 is turned on and a relay coil RC2 is excited to open the relay switch RS2, thereby stopping the supply of power to the DC motor 31.

A circuit which connects the relays, the limit switches, the up-down switch to the motor 31 constitutes a signal transmission means.

In this embodiment, unlike the first to fourth embodiments, the DC motor drives the governor 1*a* while the extent of rotation of the DC motor is controlled in an open-loop control manner without calculating the target rotational speed Nr.

Figure 16:
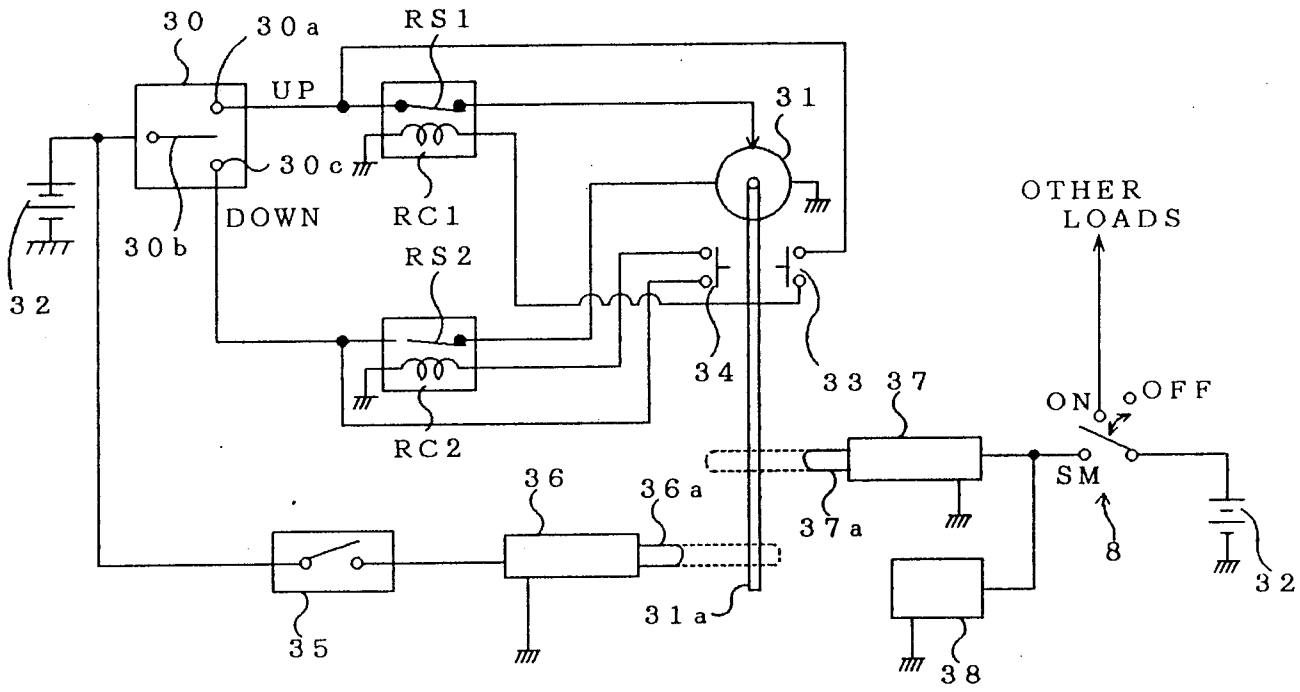
FIG. 16 is a diagram of a circuit in accordance with a modification of the fifth embodiment.

This embodiment may also be provided with a set speed command switch, such as the power mode switch shown in FIG. 2, which enables the engine speed to be immediately shifted to one of predetermined speeds selected as desired. A circuit rearranged to have this function is illustrated in FIG. 16 in which component parts corresponding to those shown in FIG. 15 are designated with the same reference characters. The description will be made mainly with respect to points of difference.

A set speed command switch 35 is an automatic return switch which is closed by being manually operated and which opens when the manual operation is stopped. When the set speed command switch 35 is closed, a solenoid 36 is connected to a battery 32. A plunger 36*a* of the solenoid 36 is thereby projected as indicated by the broken line and is retracted as indicated by the solid line. A lever 31*a* integrally connected to a rotary shaft of the DC motor 31 for driving the governor 1*a* is rotated by the projected plunger 36*a* through a predetermined angle, thereby operating the governor 1*a* so that the engine speed becomes equal to a set speed. The DC motor 31 is maintained at the rotational position to which it is moved by the projected plunger 36*a*, even after the plunger 36*a* has been retracted. This arrangement enables the speed of rotation of the engine 1 to be immediately shifted to a predetermined speed only by the on-off operation of the set speed command switch 35.

It is also possible to set the start rotation speed Nrst when the engine is started, as described above. That is, a solenoid 37 is connected to a terminal SM of a starter switch 8 which can be changed over between an off position OFF, an on position ON and a starter starting position SM. Only when a starter motor 38 is to be driven, a plunger 37*a* of the solenoid 37 is projected to the position indicated by the broken line, thereby operating the governor 1*a* so that the engine speed is adjusted to the start rotation speed.

Even if at the time of starting the engine the motor 31 is in the rotational position where it maximizes the engine speed, the motor 31 is rotated in sychronization with the starting of the starter motor 38 to the rotational position corresponding to the start rotation speed. After the engine has been started, the motor 31 is maintained at the rotational position while the plunger 37*a* is retracted to the position indicated by the solid line, thereby enabling the engine 1 to continue rotating at the predetermined start rotation speed. The engine speed increases if the up contact 30*a* is closed, decreases if the down contact 30*c* is closed, or increases to a set rotational speed if the set speed command switch 35 is closed.

Next, examples of the design of the up switch $6_U$ and the down switch $6_D$ will be described below with reference to FIGS. 17 to 20.

Figure 17:
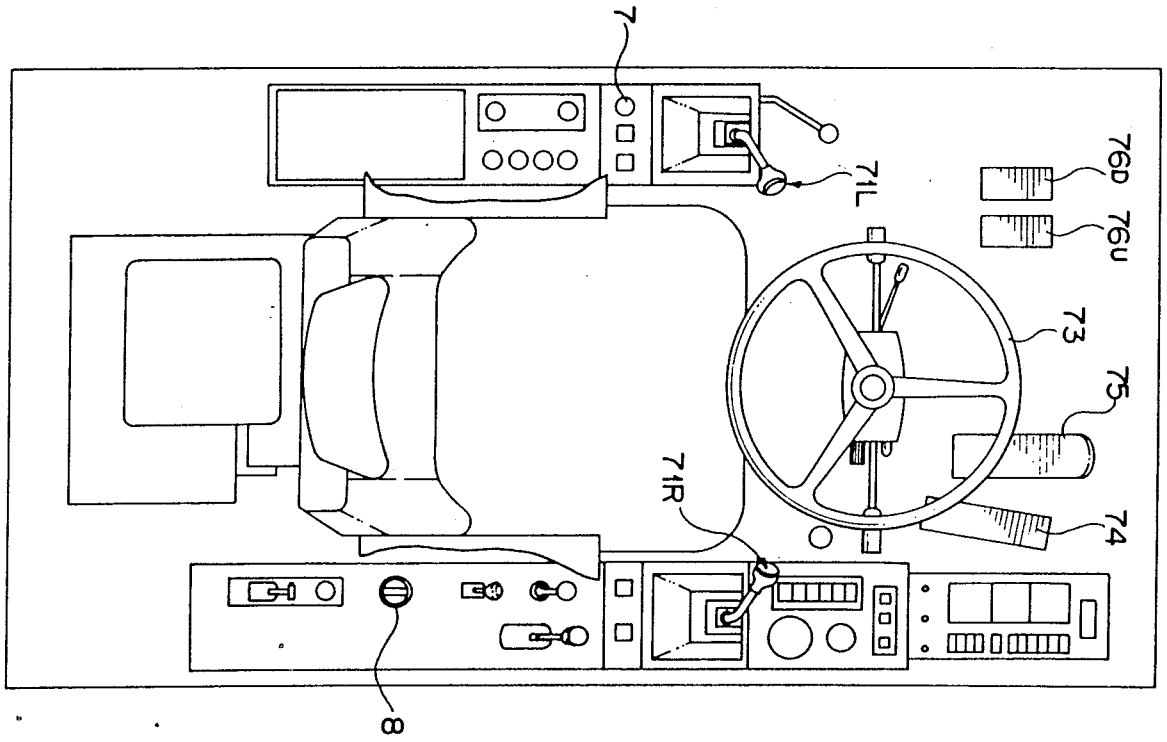
FIG. 17 is a plan view of a cockpit of a wheel type hydraulic power shovel to which the present invention is applied.
Figure 18:
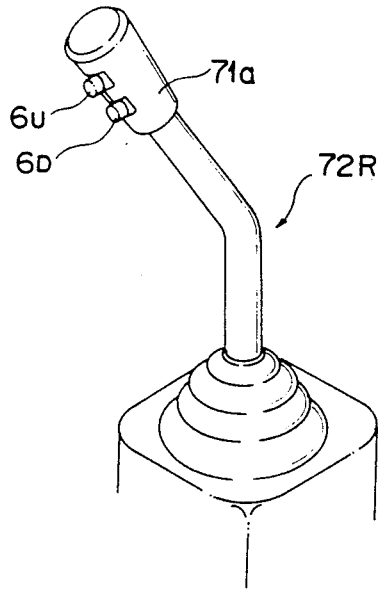
FIGS. 18 to 20 are diagrams of examples of placement of the up switch and the down switch.

FIG. 17 is a plan view of a cockpit of a wheel type hydraulic power shovel to which the above-described engine speed controller is applied. Working levers 71R and 71L for operating working actuators are provided. As shown in FIG. 18, an up switch $6_U$ and a down switch $6_D$ are provided in a grip 71*a* of the working lever 71R disposed on the right-hand side. Referring again to FIG. 17, a mode switch panel 7 having the above-described types of mode switches 7L, 7E, and 7P, the above-described type of start switch 8, a wheel 73 for steering during traveling, a traveling accelerator pedal 74 and a break pedal 75 are illustrated.

This arrangement of the up and down switches enables the operator to change the engine speed as desired while operating the working levers 71R and 71L with his two hands, thus improving the operability. The illustrated switches are of a push type automatic return switch, but automatic return toggle switches may be used as the up and down switches.

Figure 19:
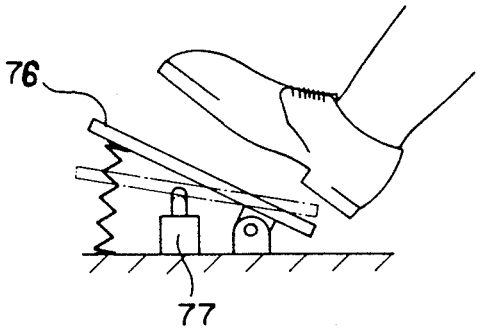

In FIG. 17, an up pedal $76_U$ and a down pedal $76_D$ are also illustrated. These pedals are provided instead of the up switch $6_U$ and the down switch $6_D$ shown in FIG. 18 As illustrated in FIG. 19, a push switch 77 is disposed under each pedal to output an up or down signal.

The provision of these pedal switches enables the operator to control the engine speed while operating the working levers 71R and 71L with his two hands, thus improving the operability as in the case of the arrangement shown in FIG. 18

Figure 20:
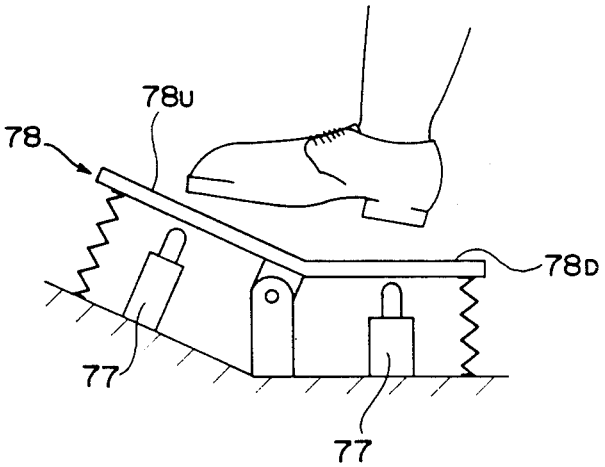

FIG. 20 shows a modification of the pedal switches. A pedal 78 has a front up-operation portion $78_U$ and a rear down-operation portion $78_D$, and push type switches 77 are disposed below the up-operation portion $78_U$ and the down-operation portion $78_D$, respectively, thereby enabling the same effects as the above-described arrangements.

In the above-described embodiments, the governor is driven by the pulse motor or the DC motor. However, the present invention can also be applied to control of the engine speed using an electronic governor without using such a mechanism. Also, it is to be construed that the present invention is not be limited to wheel type hydraulic power shovels.

What is claimed is:

1. An apparatus for controlling the rotational speed of a prime mover of a construction machine, comprising:

prime mover controller means for controlling the rotational speed of the prime mover;

drive means for driving said prime mover controller means;

up/down command operation means operated between an up position at which it outputs an up signal for increasing the rotational speed of the prime mover and a down position at which it outputs a down signal for reducing the rotational speed of the prime mover; and signal transmission means for supplying a drive signal to said drive means whereby the prime mover rotational speed is increased on the basis of said up signal and is reduced on the basis of said down signal.

2. An apparatus according to claim 1, further comprising:

set speed command means for issuing a command to shift the prime mover rotational speed to at least one set speed previously determined; and shift means for shifting the prime mover rotational speed to said set speed on the basis of a set speed command signal output from said set speed command means.

3. An apparatus according to claim 1, wherein said signal transmission means comprises control means for calculating a target prime mover speed on the basis of the up signal and the down signal, said control means supplying said drive signal to said drive means so that the prime mover rotational speed is adjusted to said target speed.

4. An apparatus according to claim 3, further comprising set speed command means for issuing a command to shift the prime mover rotational speed to at least one set speed previously determined, wherein said target prime mover speed is calculated on the basis of a set speed command signal output from said set speed command means whereby the prime mover rotational speed is adjusted to said one set speed.

5. An apparatus for controlling the rotational speed of a prime mover of a construction machine, having a hydraulic pump driven by the prime mover, an actuator driven by oil discharged from said hydraulic pump and operating means for controlling the operation of said actuator, said apparatus comprising:

prime mover controller means for controlling the rotational speed of the prime mover;

drive means for driving said prime mover controller means;

up/down command operation means operated between an up position at which it outputs an up signal for increasing the rotational speed of the prime mover and a down position at which it outputs a down signal for reducing the rotational speed of the prime mover;

detection means for detecting an operational value which represents the operation of said operation means; and control means for calculating a first target prime mover speed on the basis of the up signal and the down signal, and a second target speed on the basis of the operational value detected by said detection means, said control means supplying a drive signal to said drive means whereby the prime mover speed is adjusted to higher one of said first and second target speeds.

6. An apparatus according to claim 3, further comprising prime mover speed control value detecting means for detecting a value for control of the prime mover rotational speed effected by said prime mover controller means, wherein said control means outputs the drive signal when the difference between the detected control speed and the target speed is larger than a predetermined value.

7. An apparatus according to claim 4, further comprising prime mover speed control value detecting means for detecting a value for control of the prime mover rotational speed effected by said prime mover controller means, wherein said control means outputs the drive signal when the difference between the detected control speed and the target speed is larger than a predetermined value.

8. An apparatus according to claim 5, further comprising prime mover speed control value detecting means for detecting a value for control of the prime mover rotational speed effected by said prime mover controller means, wherein said control means outputs the drive signal when the difference between the detected control speed and the target speed is larger than a predetermined value.

9. An apparatus according to claim 3, wherein the drive signal is output when the difference between present and past target speeds calculated by said control means is larger than a predetermined value.

10. An apparatus according to claim 4, wherein the drive signal is output when the difference between present and past target speeds calculated by said control means is larger than a predetermined value.

11. An apparatus according to claim 5, wherein the drive signal is output when the difference between present and past target speeds calculated by said control means is larger than a predetermined value.

12. An apparatus according to claim 3, wherein said control means set the target speed to a predetermined start rotation speed in response to starting of the prime mover.

13. An apparatus according to claim 4, wherein said control means set the target speed to a predetermined start rotation speed in response to starting of the prime mover.

14. An apparatus according to claim 5, wherein said control means set the target speed to a predetermined start rotation speed in response to starting of the prime mover.

15. An apparatus according to claim 3, wherein said control means controls said drive means in response to stoppage of said prime mover so as to set said drive means to a position corresponding to a predetermined start rotation speed.

16. An apparatus according to claim 4, wherein said control means controls said drive means in response to stoppage of said prime mover so as to set said drive means to a position corresponding to a predetermined start rotation speed.

17. An apparatus according to claim 5, wherein said control means controls said drive means in response to stoppage of said prime mover so as to set said drive means to a position corresponding to a predetermined start rotation speed.

18. An apparatus according to claim 3, wherein when the target speed is within a predetermined rotational speed range, the driving speed of said drive means is increased to the extent depending on the present target speed.

19. An apparatus according to claim 4, wherein when the target speed is within a predetermined rotational speed range, the driving speed of said drive means is increased to the extent depending on the present target speed.

20. An apparatus according to claim 5, wherein when the target speed is within a predetermined rotational speed range, the driving speed of said drive means is increased to the extent depending on the present target speed.

21. An apparatus according to claim 3, further comprising prime mover speed control value detecting means for detecting a value for control of the prime mover speed effected by said prime mover controller means, wherein when the target speed is within a predetermined rotational speed range, the driving speed of said drive means is increased to the extent depending on the present target speed.

22. An apparatus according to claim 4, further comprising prime mover speed control value detecting means for detecting a value for control of the prime mover speed effected by said prime mover controller means, wherein when the target speed is within a predetermined rotational speed range, the driving speed of said drive means is increased to the extent depending on the present target speed.

23. An apparatus according to claim 5, further comprising prime mover speed control value detecting means for detecting a value for control of the prime mover speed effected by said prime mover controller means, wherein when the target speed is within a predetermined rotational speed range, the driving speed of said drive means is increased to the extent depending on the present target speed.

24. An apparatus according to claim 3, wherein when the target speed is within a predetermined rotational speed range, the driving speed of said drive means is increased to the extent depending on the period of time for which said up/down command operation means is operated.

25. An apparatus according to claim 4, wherein when the target speed is within a predetermined rotational speed range, the driving speed of said drive means is increased to the extent depending on the period of time for which said up/down command operation means is operated.

26. An apparatus according to claim 5, wherein when the target speed is within a predetermined rotational speed range, the driving speed of said drive means is increased to the extent depending on the period of time for which said up/down command operation means is operated.

27. An apparatus according to claim 3, further comprising prime mover speed control value detecting means for detecting a value for control of the prime mover speed effected by said prime mover controller means, wherein when the target speed is within a predetermined rotational speed range, the driving speed of said drive means is increased to the extent depending on the difference between the target speed and the control speed.

28. An apparatus according to claim 4, further comprising prime mover speed control value detecting means for detecting a value for control of the prime mover speed effected by said prime mover controller means, wherein when the target speed is within a predetermined rotational speed range, the driving speed of said drive means is increased to the extent depending on the difference between the target speed and the control speed.

29. An apparatus according to claim 5, further comprising prime mover speed control value detecting means for detecting a value for control of the prime mover speed effected by said prime mover controller means, wherein when the target speed is within a predetermined rotational speed range, the driving speed of said drive means is increased to the extent depending on the difference between the target speed and the control speed.

30. An apparatus according to of claim 1, said construction machine comprises a hydraulic pump driven by the prime mover, a plurality of actuators driven by oil discharged from said hydraulic pump and a plurality of operating levers provided in association with said actuators to control the operations of the said actuators.

31. An apparatus according to of claim 2, said construction machine comprises a hydraulic pump driven by the prime mover, a plurality of actuators driven by oil discharged from said hydraulic pump and a plurality of operating levers provided in association with said actuators to control the operations of the said actuators.

32. An apparatus according to of claim 3, said construction machine comprises a hydraulic pump driven by the prime mover, a plurality of actuators driven by oil discharged from said hydraulic pump and a plurality of operating levers provided in association with said actuators to control the operations of the said actuators.

33. An apparatus according to of claim 4, said construction machine comprises a hydraulic pump driven by the prime mover, a plurality of actuators driven by oil discharged from said hydraulic pump and a plurality of operating levers provided in association with said actuators to control the operations of the said actuators.

* * * * *